US009877598B2

(12) United States Patent
Fine

(10) Patent No.: US 9,877,598 B2
(45) Date of Patent: Jan. 30, 2018

(54) UPRIGHT CHILD HIGH CHAIR

(71) Applicant: Carolyn Sara Fine, Portland, OR (US)

(72) Inventor: Carolyn Sara Fine, Portland, OR (US)

(73) Assignee: RED CLOVER, LLC, Portland, OR (US)

( * ) Notice: Subject to any disclaimer, the term of this patent is extended or adjusted under 35 U.S.C. 154(b) by 0 days.

(21) Appl. No.: 14/682,720

(22) Filed: Apr. 9, 2015

(65) Prior Publication Data

US 2015/0289673 A1 Oct. 15, 2015

Related U.S. Application Data

(60) Provisional application No. 61/977,536, filed on Apr. 9, 2014.

(51) Int. Cl.

| | |
|---|---|
| ***A47B 83/02*** | (2006.01) |
| ***A47C 7/50*** | (2006.01) |
| ***A47D 15/00*** | (2006.01) |
| ***A47D 1/00*** | (2006.01) |

(52) U.S. Cl.

CPC ..... *A47D 15/006* (2013.01); *A47D 1/008* (2013.01)

(58) Field of Classification Search

CPC ..... A47D 1/002; A47D 1/004; A47D 1/008; A47C 16/025; A47B 15/006

USPC ..... 297/423.38, 138, 174 R, 153, 256.11, 297/423.1, 423.12, 423.25, 423.42, 297/423.45, 313, 314, 148–156, 423.19, 297/423.22, 423.23

See application file for complete search history.

(56) References Cited

U.S. PATENT DOCUMENTS

| | | | | | |
|---|---|---|---|---|---|
| 517,403 | A | * | 3/1894 | Bradish et al. | B62K 9/02 280/87.03 |
| 811,881 | A | * | 2/1906 | Steinbach | A47C 9/002 297/313 |
| 1,326,921 | A | * | 1/1920 | Dzimitowicz | A47D 13/043 297/136 |
| 1,578,040 | A | * | 3/1926 | Kilmer | A47D 15/006 297/440.11 |
| 1,688,922 | A | * | 10/1928 | Drinosky, Jr. | A47D 13/043 280/87.051 |
| 1,768,905 | A | * | 7/1930 | Hartman | A47D 13/105 297/423.38 |

(Continued)

OTHER PUBLICATIONS

International Search Report for PCT/US2015/025141 dated Jul. 2, 2015; 11 pages.

(Continued)

*Primary Examiner* — Rodney B White

(74) *Attorney, Agent, or Firm* — Schwabe Williamson & Wyatt, PC

(57) ABSTRACT

An upright child high chair may include a seat configured to support the weight of the child and maintain an upright body position of the child. The seat may include two symmetrically opposed apertures for accommodating the child's legs extending in the upright body position below the seat. The high chair may further include a base structure attached to the seat and extending downward from the seat. A platform may be attached to the base structure and may be located below the seat. The platform may be configured to deflect from a resting position in response to a force applied to the platform by the child while the seat continues to substantially support the weight of the child.

20 Claims, 15 Drawing Sheets

(56) References Cited

U.S. PATENT DOCUMENTS 1,861,661 A * 6/1932 Huerlin ..... A47D 13/107 182/137
1,887,234 A * 11/1932 Copenhaver ..... A47D 1/008 297/423.26
1,950,042 A * 3/1934 Upper ..... A47D 13/107 297/136
2,532,812 A * 12/1950 Huber ..... A47D 1/008 297/149
2,568,832 A * 9/1951 Stone ..... B60N 2/502 297/314 X
2,606,593 A 8/1952 Beurskens
2,857,956 A * 10/1958 Thompson ..... A47D 3/005 297/133
2,862,710 A * 12/1958 Lewis ..... A63G 13/08 248/160
2,976,911 A * 3/1961 Barker ..... A47D 13/107 297/153
2,978,245 A * 4/1961 Rempel ..... A63G 13/08 472/105
3,188,141 A * 6/1965 Wright ..... A47C 16/025 297/423.42
3,195,890 A * 7/1965 Salls ..... A63B 25/08 482/128
3,220,772 A * 11/1965 Lucky ..... A47B 91/06 297/423.42
3,331,631 A * 7/1967 Pierson, Jr. ..... A47D 13/102 297/259.4
3,494,613 A * 2/1970 Hatfield ..... A63G 13/04 267/178
3,692,359 A * 9/1972 Boucher ..... A47D 1/08 280/30
3,701,529 A 10/1972 Kruthaupt
3,747,596 A * 7/1973 Mills ..... A47D 13/04 128/845
4,160,553 A * 7/1979 Fleischer ..... A47C 3/025 248/601
4,165,127 A * 8/1979 Vago ..... A61G 5/00 297/423.19 X
4,626,030 A * 12/1986 Kassai ..... B62B 9/10 280/47.4
4,743,008 A * 5/1988 Fermaglich ..... A47D 13/043 297/137
4,844,547 A * 7/1989 Adkins ..... B61B 12/002 248/578
4,863,216 A 9/1989 Prescott
4,900,011 A 2/1990 Nolet
5,380,023 A 1/1995 McBee
5,407,246 A * 4/1995 Meeker ..... A47D 13/102 248/372.1
5,451,093 A * 9/1995 Petrie ..... A47D 13/107 297/314 X
5,499,949 A * 3/1996 Heubl ..... A47D 13/107 297/274
5,569,131 A * 10/1996 Giulianelli ..... A63B 25/08 446/226
5,570,929 A * 11/1996 Glockl ..... A47C 9/002 297/313
5,688,211 A 11/1997 Myers
5,690,383 A * 11/1997 Meeker ..... A47D 13/107 297/274
5,700,201 A * 12/1997 Bellows ..... A47D 13/107 297/137
5,732,961 A * 3/1998 Theodoropoulos .. A47D 13/043 280/87.051
5,782,532 A * 7/1998 Opsvik ..... A47C 3/20 297/338
5,795,022 A * 8/1998 Brown ..... A47C 9/002 297/314 X
5,857,944 A * 1/1999 Cone ..... A47D 13/107 297/274
5,860,696 A * 1/1999 Opsvik ..... A47D 1/00 297/219.1
5,934,747 A * 8/1999 Garland ..... A47D 11/00 297/136
5,984,837 A 11/1999 Weaver
6,000,750 A * 12/1999 Rossman ..... A47D 1/004 108/11
6,299,247 B1 10/2001 Meeker
6,368,260 B1 * 4/2002 Crews ..... A63B 21/0552 482/130
6,375,599 B1 4/2002 Brown
6,676,475 B1 1/2004 Henderson
6,817,864 B1 * 11/2004 Martinez ..... A47D 1/008 434/258
6,854,799 B1 * 2/2005 Asbach ..... A47D 3/00 297/136
7,008,357 B2 * 3/2006 Winkler ..... B60N 3/063 297/5
7,287,768 B2 * 10/2007 Myers ..... A47D 3/00 280/649
7,520,840 B2 * 4/2009 Shifferaw ..... A63B 23/0458 482/146
7,523,984 B2 * 4/2009 Steininger ..... A47D 1/008 280/87.05
7,614,979 B2 11/2009 Thomson
7,727,076 B2 * 6/2010 Bapst ..... A47D 13/105 472/103
7,740,560 B2 * 6/2010 Tadin ..... A47D 3/00 482/27
7,992,935 B2 * 8/2011 Opsvik ..... A47D 15/006 297/219.12
8,042,869 B2 10/2011 McClintock
8,240,765 B2 * 8/2012 Kennedy ..... A47D 1/002 297/151
8,302,978 B2 11/2012 You
8,303,033 B2 * 11/2012 Lundeen ..... A47D 3/00 297/136
8,348,811 B2 * 1/2013 Kamins ..... A61B 35/1071 482/52
9,010,711 B2 * 4/2015 Pleiman ..... A47B 81/00 248/423
2002/0164917 A1 * 11/2002 Keegan ..... A47D 13/043 446/71
2005/0277517 A1 * 12/2005 Snyderman ..... A63B 22/0605 482/52
2012/0026000 A1 2/2012 Chen
2012/0261957 A1 10/2012 Tadin
2017/0079437 A1 * 3/2017 Micol ..... A47C 5/00

OTHER PUBLICATIONS

Bright Starts—Bounce Bounce Baby, Model #60245; retrieved from <http://www.kidsii.com/brightstarts/p-783-bounce-bounce-baby.aspx> on Feb. 27, 2014; 1 page.
Bright Starts—Springin' Safari Bounce-A-Round, Model #60266; retrieved from <http://kidsii.com/brightstarts/p-683-springin-safari-bounce-a-round.aspx> on Feb. 27, 2014; 1 page.
Bright Starts—Sweet Safari Bounce-A-Round, Model #60330; retrieved from <http://www.kidsii.com/brightstarts/p-813-sweet-safari-bounce-a-round.aspx> on Feb. 27, 2014; 1 page.
Bright Starts—Zoo Tails Bounce Bounce Baby, Model #60054; retrieved from <http://www.kidsii.com/brightstarts/p-534-zoo-tails-bounce-bounce.aspx> on Feb. 27, 2014; 1 page.
Kids II, Inc.—Obounce Activity Center, Model #60265; retrieved from <http://www.kidsii.com/oball/p-778-obounce-activity-centeraspx> on Feb. 27, 2014; 2 pages.

* cited by examiner

UPRIGHT CHILD HIGH CHAIR

RELATED APPLICATIONS

This application claims the benefit of U.S. Provisional Application No. 61/977,536, filed Apr. 9, 2014, which content is herein incorporated by reference in its entirety.

BACKGROUND

Babies are born with a stepping reflex, a biological imperative to push down with their feet and straighten their legs. The stepping reflex is a precursor to walking. By the time they are six months old those movements are becoming more refined and they want to practice those skills all the time. That is also the age at which we start to feed them solid foods.

Traditional high chairs place a baby in a seated position, where the baby's legs are forced in a direction perpendicular to the baby's upper body. Because babies want to stand, step, and move all the time, the rigid, seated position is in direct conflict with the developmental needs of the baby, causing stress, anxiety, and a difficult feeding/eating relationship.

There is increasing awareness of the importance of a high chair to a child's development. Mealtime is where a small child begins to develop language skills. High chair time allows them to join in family social interaction. And since movement spurs their mental and physical growth, both sitting and the inability to move hamper an infant's development.

SUMMARY

A high chair for a child is disclosed herein. The high chair may include a seat configured to support the weight of the child and maintain an upright body position of the child. The seat may include two symmetrically opposed apertures for accommodating the child's legs extending in the upright body position below the seat.

The improved baby feeding chair allows a baby to keep its body in an upright, standing orientation while still being securely stabilized and confined to the chair. The baby can step and push his feet downward against a stepping platform to give him the sense that he is walking or standing. The improved baby feeding chair provides the baby with a sense of autonomy and control over his own body. The baby feeding chair allows a baby sitting within the chair to step, push, and kick with his feet while preventing upward motion of the baby's upper body.

The high chair may further include a base structure attached to the seat and extending downward from the seat. A platform may be attached to the base structure and may be located below the seat. The platform may be configured to deflect from a resting position in response to a force applied to the platform by the child while the seat continues to substantially support the weight of the child.

An apparatus for supporting a child is disclosed herein. The apparatus may include a seat configured to support the child. The seat may include two apertures allowing the child's feet to extend beneath the seat. A base structure may be attached to the seat and may support the seat on a surface.

A platform may be attached to the base structure and may be located at least partially directly beneath the seat. The platform may be configured to displace from an initial position in response to a force applied to the platform by the feet of the child while the child remains supported by the seat, and wherein the platform is configured to return to the initial position in response to removal of the force.

A table-mounted child chair is disclosed here. The table-mounted child chair may include a seat configured to support a child. The seat may include two apertures allowing the child's feet to extend below the seat. A support surface may be attached to the seat and may support the seat adjacent to the table. A mounting structure may be utilized for mounting the supporting surface to the table.

One or more platform-mounting extensions may extend from the bottom of the support surface. The one or more extensions may be elevated above a surface located directly below the table-mounted child chair. A platform may be attached to the one or more extensions and may be located below the seat. The platform may be configured to deflect from an initial position in response to a force applied to the platform by the feet of the child and return to the initial position in response to removal of the force.

DETAILED DESCRIPTION

A high chair allows a child sitting within the chair to step, push, and kick with his feet while preventing upward motion of the child's upper body. This lack of upward motion allows the child to more easily handle foods and drinks, thereby leading to fewer spills. Additionally, the lack of motion of the child's upper body provides a more stable support due to the lack of additional forces on the chair that may be created by the motion of the child's body. Further, the high chair prevents the child from placing his feet on the seat of the high chair and creating upward motion pushing himself out of the high chair. These are just some advantages to the improved high chair and this disclosure should not be construed as limiting the advantages over the prior art to the above disclosure.

Figure 1:
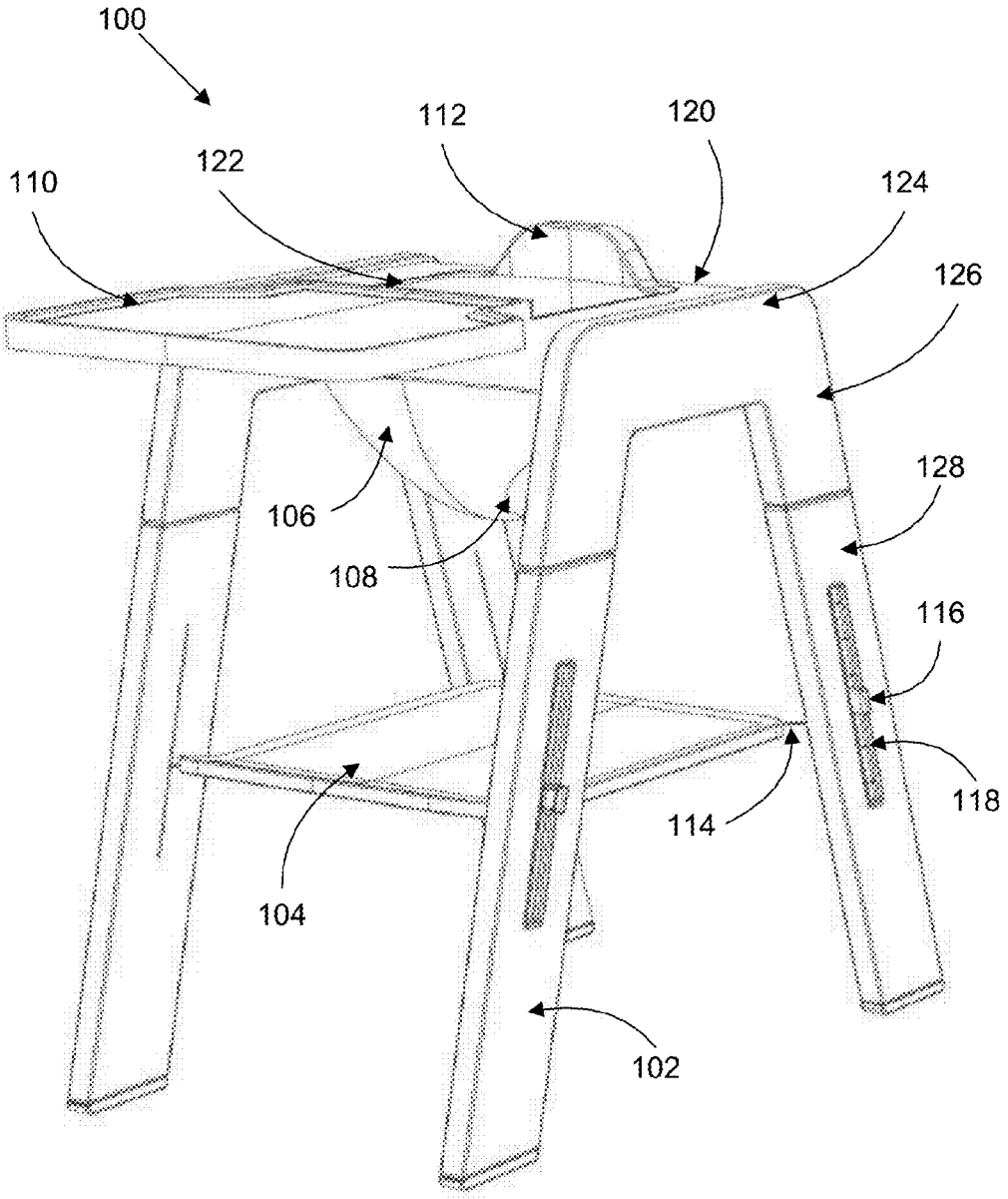
FIG. 1 illustrates a perspective view of an example high chair for a child including a platform.

FIG. 1 illustrates a perspective view of an example high chair 100 for a child including a platform 104. The high chair 100 may include a seat 106 configured to support a weight of the child and maintain an upright body position of the child, aligning the child's head with the child's spine. The seat 106 may be made of a pliable material, such as cloth, rubber, leather, plastic, any other type of pliable material, or any combination thereof. The seat 106 may be substantially semi-spherical in shape. However, it is to be understood that the seat 106 may comprise other shapes, and may be elongated in the horizontal or vertical directions.

The seat 106 may comprise a saddle-style seat with two symmetrically-opposed apertures 108 for accommodating the legs of the child extending in the upright body position below the seat 106. A first one of the apertures 108 may be located to the right of a central plane bisecting the high chair 100 and a second one of the apertures 108 may be symmetrically mirrored around the central plane. The apertures 108 may be in alignment with the child's upper body when placed within the seat 106.

While the seat 106 is described as having two symmetrically-opposed apertures 108, it is to be understood that the seat 106 may include one or more apertures and the apertures may be located anywhere on the seat, including being asymmetrically positioned. For example, the seat 106 may include a single aperture with a piece of material, such as a strap, bisecting the aperture, where the piece of material may support the weight of the child.

In some examples, the seat 106 may be made of a rigid type of material, such as wood, hard plastic, metal, any other type of rigid material, or any combination thereof. The rigid material of the seat 106 may be molded to provide comfort of the child when placed within the seat 106.

In some examples, the seat 106 may be designed such that the child is placed in a seated position with the child's legs extending in front of the seat 106. The apertures 108 may be located toward a front portion of the seat 106 allowing the child's legs to extend forward from the seat 106 rather than downward.

The seat 106 may be attached to a support structure 120 that supports the seat 106. The support structure 120 may include a cutout 122 to which the seat 106 is attached. The top portion of the seat 106 may be attached around the cutout 122 and the seat may extend downwards from the cutout 122.

The support structure 120 may include a seat back 112 extending upward along the back of the cutout 122. The seat back 112 may be flat or may be curved to provide support for the natural curve of the child's back. Further, the seat back 112 may be made of a hard surface, such as plastic or wood, may provide cushioning for greater comfort of the baby, or any combination thereof. In some examples, the seat back 112 may extend around the seat 106, partially around the seat 106, may extend around a back portion of the seat 106, or any combination thereof.

A feeding surface 110 may be attached to the front portion of the support structure 120. The feeding surface 110 may extend horizontally from the support structure 120, the seat 106, the cutout 122, or any combination thereof, thereby providing a surface on which to set the child's food or drink. The edge of the feeding surface 110 towards the seat 106 may be contoured to follow a front edge of the cutout 122, reducing any edges that may cause irritation to the child.

While the feeding surface 110 is described as being attached to the front portion of the support structure 120, it is to be understood that the feeding surface 110 may be attached to any part of the support structure 120, the seat 106, the seat back 112, a base structure 124 of the high chair 100, or any combination thereof. Further, the feeding surface 110 may extend in any direction from the cutout 122, may extend around a portion or the entire circumference of the cutout 122, or any combination thereof.

In some examples, feeding surface 110 may comprise a food tray with a removable tray insert. The removable tray insert may be easily removed for cleaning or may be replaced with a different tray insert as necessary. In some examples, the feeding surface 110 may be removable from the high chair 100, thereby allowing the high chair 100 to be pushed up against a table allowing the child to utilize the table for placement of items.

The support structure 120 may be a part of the base structure 124. The base structure 124 may extend downward from the seat 106 and support the seat 106 on a supporting surface, such as a floor or the ground. The base structure 124 may comprise four legs 102 that contact the supporting surface at an end of the legs. It is to be understood that the base structure 124 may comprise more or less than four legs, or may comprise any other supporting structure, such as a podium, a pedestal, or any combination thereof. The legs 102 may be attached to the seat 106, the seat back 112, the feeding surface 110, or any combination thereof.

The base structure 124 may comprise an upper portion 126 and a lower portion 128. In some examples, the upper portion 126 and the lower portion 128 may be separable from each other, allowing for the high chair 100 to be disassembled for storage. Further, either the upper portion 126 or the lower portion 128 may be separately replaced due to damage of either portion, to upgrade or change of one of the portions to a different style or make, or to retrofit with other high chairs or child seats. For example, a user may own an upper portion having a cloth seat, but would prefer to have a leather seat. The user may be able to purchase an upper portion with the leather seat and change out the upper portions while still utilizing the same lower portion.

The high chair 100 may further include a platform 104 attached to the base structure 124. The platform 104 may be attached to the base structure 124 by one or more attachment mechanisms 114. In some examples, the attachment mechanisms 114 may attach the platform 104 to other parts of the high chair 100, including the seat 106, the feeding surface 110, the cutout 122, the seat back 112, or any combination thereof.

The attachment mechanisms 114 may comprise any elastic material or mechanism, which allows the attachment mechanisms 114 to stretch and resiliently return to a static length, such as bungee cords, springs, rubber bands, elastic tubing, any other type of elastic material, or any combination thereof. The attachment mechanisms 114 may be configured to expand in response to force being applied to the platform 104, allowing the platform 104 to be displaced from a resting position. In response to the force being removed from the platform 104 or reduced, the attachment mechanisms 114 may retract, returning the platform 104 to, or substantially to, the resting position.

In some examples, the attachment mechanisms 114 may be inelastic, such as rope, screws, bolts, hooks, or any combination thereof. The inelastic attachment mechanisms 114 may be rigidly mounted to the base structure 124, may be rotationally attached to the base structure, or any combination thereof.

The quantity of the attachment mechanisms 114 may vary depending on the desired number of connection points between the platform 104 and the base structure 124. The quantity of the attachment mechanisms 114 may be equal to the number of legs comprising the base structure 124, the number edges of the platform 104, the number of corners of the platform 104, or any combination thereof. The high chair 100 may include four attachment mechanisms 114 affixed to the four corners of the platform 104 and attaching the platform 104 to four legs comprising the base structure 124.

In some examples, the attachment mechanisms 114 may be detachable from the platform 104, the base structure 124, or any combination thereof. The ability to detach the attachment mechanisms 114 may provide for easy replacement of the attachment mechanisms 114 and/or the platform 104 as desired.

The base structure 124 may include one or more attachment points for the attachment mechanisms 114 at different vertical positions along the base structure 124. The resting position of the platform 104 may be adjusted by connecting the attachment mechanisms 114 to different attachment points along the base structure 124.

The attachment mechanisms 114 may suspend the platform 104 between the seat 106 and a surface on which the high chair 100 is placed. The platform 104 may extend among the legs 102 of the base structure 124 and at least a portion of the platform 104 may be located directly beneath the seat 106. The platform 104 may be positioned at a distance below the seat 106 such that a child sitting in the high chair can contact the platform 104 with his feet.

In some examples, the attachment mechanism 114 may suspend the platform 104 in front of the seat 106. For example, when the seat 106 places the child in a seated-position, the platform 104 may be placed in front of the seat 106 such that the child can contact the platform 104.

As the child's feet contact the platform 104 and a corresponding force is applied to the platform 104, the platform 104 may be configured to deflect from a resting position. The ability of the child to exert a force on the platform 104 may provide the child with a sense that he is standing or walking. The seat 106 may be configured such that a baby is able to maintain a straight up and down orientation. The seat 106 may comprise a plurality of holes, apertures, or any combination thereof, allowing for a baby's legs to extend downwards out of the seat 106. The rigid stepping platform 104 may be configured to be height-adjustable, thereby allowing the rigid stepping platform 104 to be adjusted to a height where the baby's feet can just barely reach the rigid stepping platform 104. Placing the rigid stepping platform 104 at the edge of the babies reach prevents the baby from using the rigid stepping platform 104 to push himself up and out of the seat, or bounce up and down while he is eating. The platform 104 may be configured to provide a minimal amount of resistance force to the deflection, such that all, or substantially all, of the weight of the child remains supported by the seat 106. Due to the minimal amount of upward force supplied by the platform 104 while being deflected, the upper body of the child within the seat 106 may remain in a substantially similar vertical position.

The platform 104 may comprise a rigid material, such as plastic, wood, metal, hard rubber, any other type of rigid material, or a combination thereof. The attachment mechanisms 114 attaching the rigid platform 104 to the base structure 124 may comprise an elastic material. As the child applies the force to the rigid platform 104, the attachment mechanisms 114 may expand allowing the platform 104 to be displaced while the platform 104 remains rigid. When the force is removed, the attachment mechanisms 114 may retract, thereby resiliently returning the platform 104 to the resting position.

In other examples, the platform 104 may comprise a pliable material, such as cloth, rope, soft rubber, canvas, woven polypropylene, any other type of pliable material, or any combination thereof. The pliable platform 104 may be configured to bend, flex, stretch, or any combination thereof, in response to the child applying force to the platform 104. The attachment mechanisms 114 used with the pliable platform 104 may be made of an elastic material that may stretch as the force is applied to the platform 104, may be made of a rigid material that remains rigid as the platform 104 displaces, or any combination thereof.

The platform 104 may be rectangular and may be attached to the base structure 124 by attachment mechanisms 114 located at each corner of the platform 104. While the platform 104 is illustrated as a rectangle, it is to be understood that the platform 104 may be any shape, may include any number of sides, may have curved edges, or any combination thereof. Further, the attachment mechanisms 114 may connect to the platform 104 at any location, may comprise a harness extending through, under, or above the platform 104 and supporting the platform 104, or any combination thereof.

The high chair 100 may further include one or more adjustment mechanisms 116 for adjusting the resting position of the platform 104. The adjustment mechanisms 116 may operate in combination with adjustment slots 118 for adjusting the resting position of the platform 104. The adjustment slots 118 may extend substantially vertically along the base structure 124 and may include one or more locking positions at which the adjustment mechanisms 116 may be locked in place.

When locked in place, the adjustment mechanisms 116 may remain in the locked position while the platform is displaced by the force applied by the child. When the adjustment mechanisms 116 are unlocked, the adjustment mechanisms 116 may be moved to a different locking position of the adjustment slots 118 and may be locked in the new position. The adjustment mechanisms 116 may comprise a pressure-actuated mechanism, where the adjustment mechanisms 116 are unlocked when squeezed and locked when pressure is not being applied to the adjustment mechanisms 116. While the adjustment mechanisms 116 are described as a pressure-actuated mechanisms, it is to be understood that may be locked and unlocked by any other means, such as rotation of the adjustment mechanisms 116, displacement force sliding the adjustment mechanisms 116 from the locking positions, any other type of actuation, or any combination thereof.

In some examples, the adjustment mechanisms 116 may be connected to the base structure 124 by means other than the adjustment slots 118. For example, the base structure 124 may comprise a series of holes into which the adjustment mechanisms 116 may be inserted to adjust the position of the platform 104. Further, the adjustment mechanisms 116 may be friction mounted to the base structure 124, such as that the adjustment mechanisms 116 may form loops configured to be tightened around the base structure 124 to lock the adjustment mechanisms 116 in position.

The platform 104 may be adjusted in the vertical direction, thereby changing a distance between the seat 106 and the platform 104. The platform 104 may be adjusted to a height corresponding the length of the child's legs extending downward from the seat 106, such that the child's feet may contact the platform 104, but is unable to generate a substantial amount of upward force to allow the child to bounce or push himself out of the seat 106. As the child grows, the height of the platform 104 may be adjusted to accommodate different lengths of legs.

Figure 2:
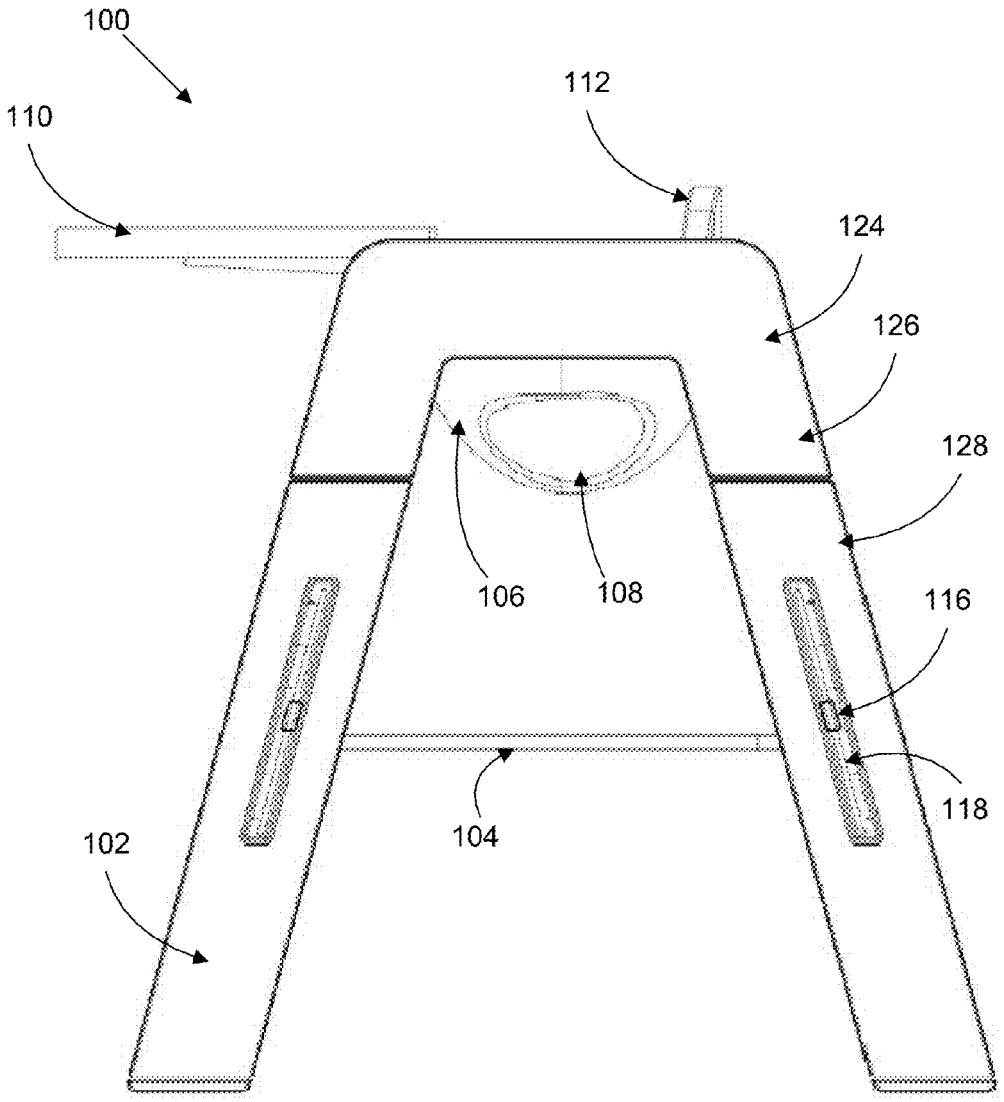
FIG. 2 illustrates a side view of the example high chair of FIG. 1.

FIG. 2 illustrates a side view of the example high chair 100 of FIG. 1. As can be seen, the apertures 108 may be oval-shaped and located within a lower portion of the seat 106, allowing the child's legs to comfortably extend below the seat 106. However, it is to be understood that the apertures 108 may be of any shape and may be located in any location of the seat 106. In some examples, the seat 106 may include a single aperture 108 with a strap, or other means of support, passing across or through the aperture 108 for supporting the weight of the child.

The legs 102 of the base structure 124 may form an upside-down 'V' with the front legs of the base structure 124 extending toward the front of the high chair 100 and the back legs of the base structure 124 extending toward the back of the high chair 100. The upside-down 'V' configuration may provide for greater stability of the high chair 100.

Figure 3:
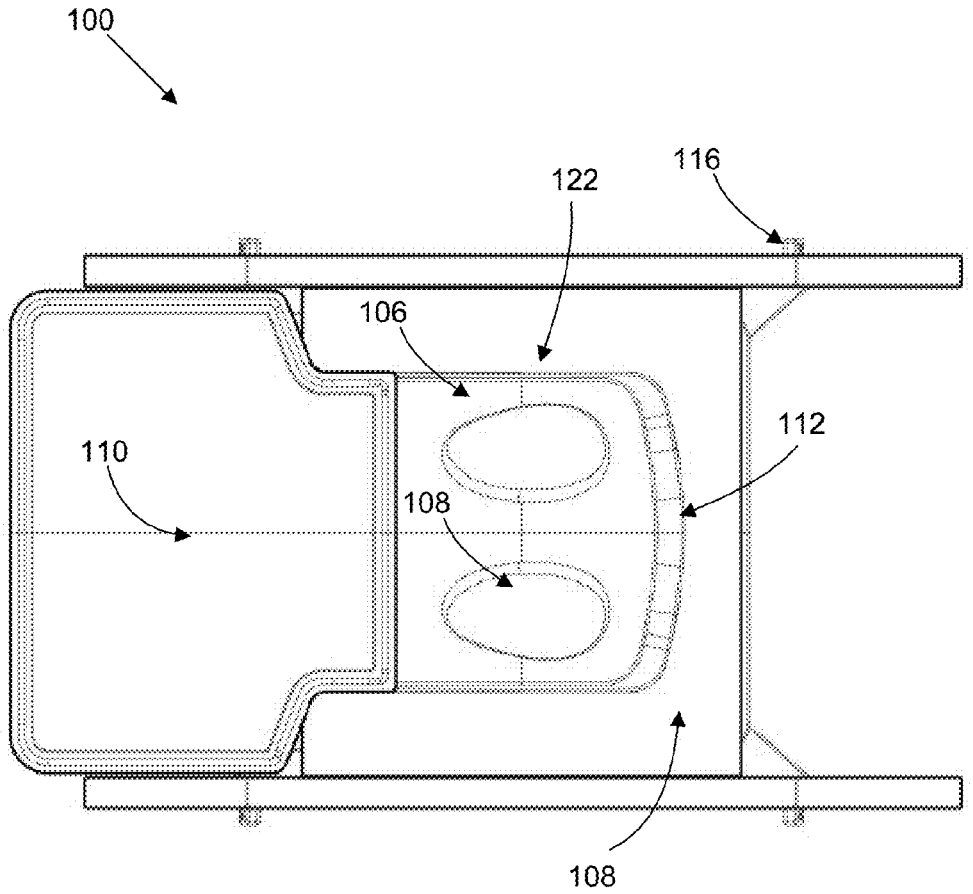
FIG. 3 illustrates a top view of the example high chair of FIG. 1.

FIG. 3 illustrates a top view of the example high chair 100 of FIG. 1. As can be seen, the apertures 108 of the seat 106 may be symmetrically opposed around bisecting line 130. In other examples, the apertures may be asymmetrical around the bisecting line 130 or may be symmetrical around a different line or plane.

The feeding surface 110 may be substantially rectangular-shaped with a portion of the feeding surface 110 extending to the front of the seat 106. In some examples, the feeding surface 110 may comprise different shapes, such as ovals, circles, polygons, other shapes, or a combination thereof. Further, the feeding surface 110 may be detachable from the high chair 100 and may be replaced by a different feeding surface 110 having a different shape.

In some examples, the feeding surface 110 may extend to the support surface 120 rather than to the seat 106. The feeding surface 110 may extend over a portion of the support surface 120 or may abut to an edge of the support surface 120. In some examples, the feeding surface 110 may be flush with the support surface 120, such that the support surface 120 may be used for placing items, such as food or drinks on.

In some examples, the feeding surface 110 may extend around a portion or the entire circumference of the seat 106. The feeding surface 110 may extend radially from the seat 106 in one or more directions providing for more surface area on which to place items.

Figure 4:
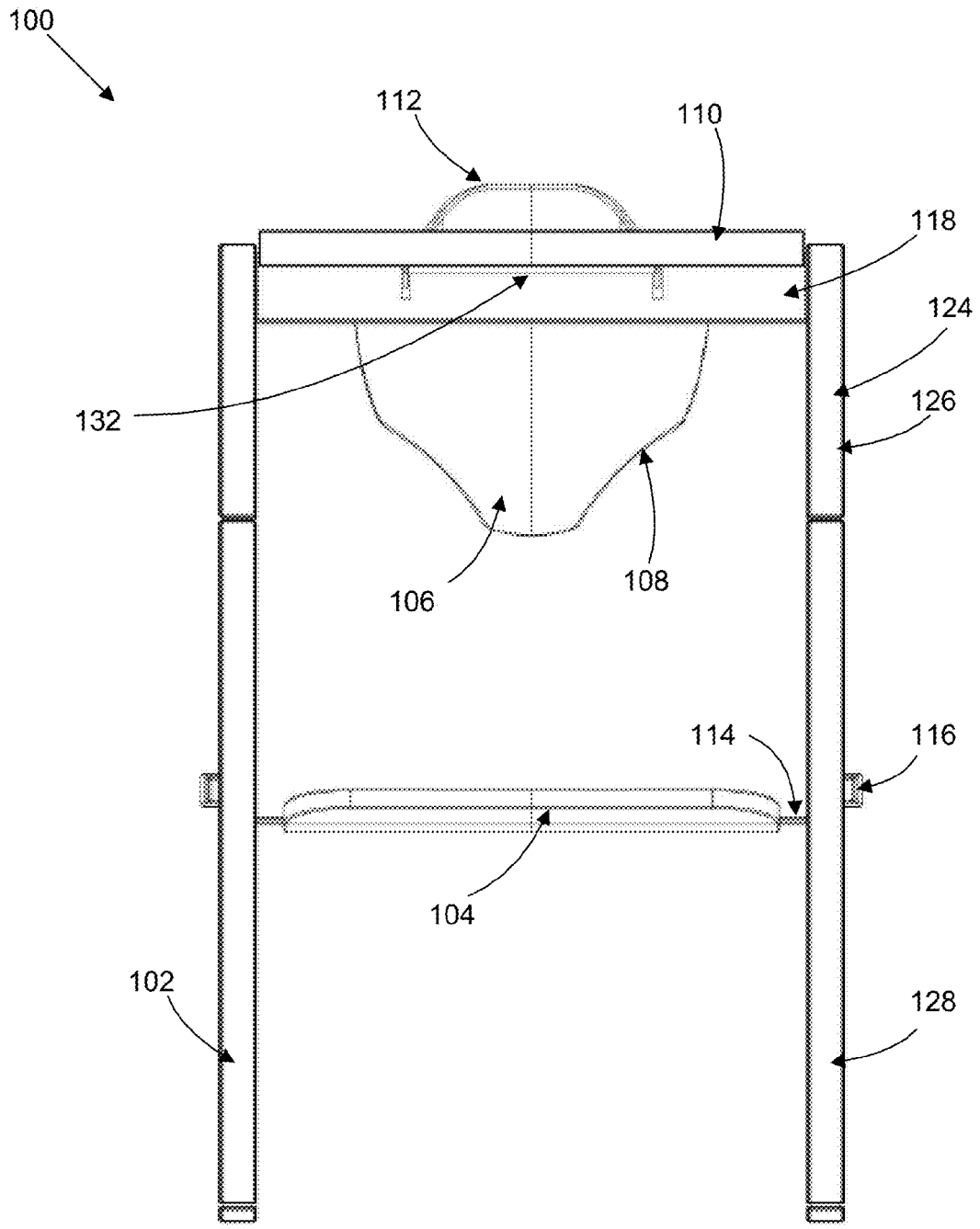
FIG. 4 illustrates a front view of the example high chair of FIG. 1.

FIG. 4 illustrates a front view of the example high chair 100 of FIG. 1. The high chair 100 may include a mounting bracket 132 for mounting the feeding surface 110 to the support surface 118. In some examples, the mounting bracket 132 may mount the feeding surface 110 to one or more of the other elements of the high chair, including the seat 106, the base structure 124, the seat back 112, or any combination thereof.

The mounting bracket 132 may be configured to allow easy removal of the feeding surface 110 from the high chair 100. Further, the mounting bracket 132 may be configured to accommodate replacement feeding surfaces or different feeding surfaces of different size or shape. In some examples, the mounting bracket 132 may irremovably attach the feeding surface 110 to the high chair 100 rather than allowing removal of the feeding surface 110.

Figure 5:
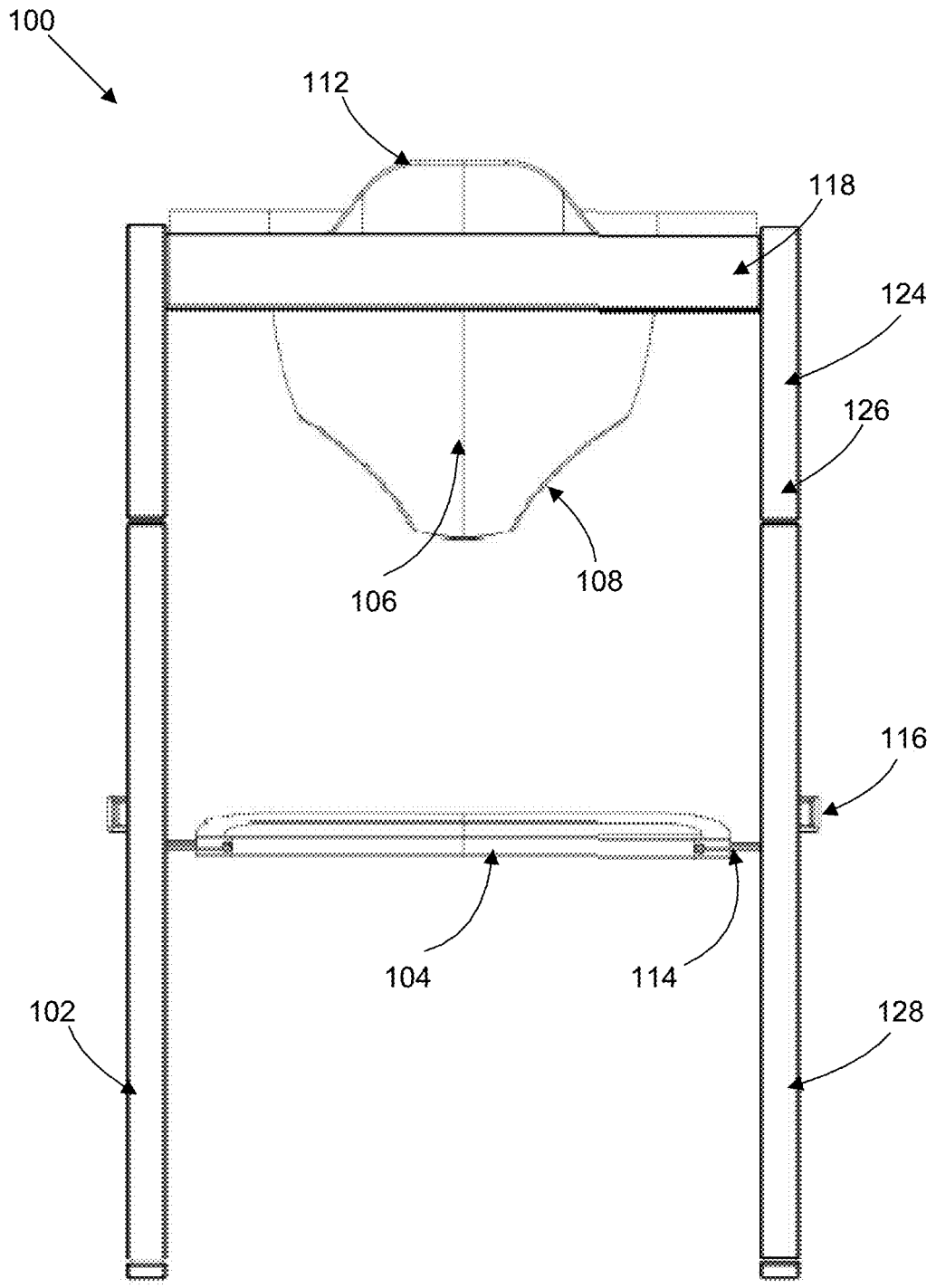
FIG. 5 illustrates a rear view of the example high chair of FIG. 1.

FIG. 5 illustrates a rear view of the example high chair 100 of FIG. 1. The high chair 100 may comprise one or more of the features described throughout this disclosure. It is to be understood that some examples of the high chair 100 may comprise all the components described above, while other examples of the high chair 100 may omit one or more of the components described above, may include other components described throughout this disclosure in lieu of one or more of the components described above, or any combination thereof.

Figure 6:
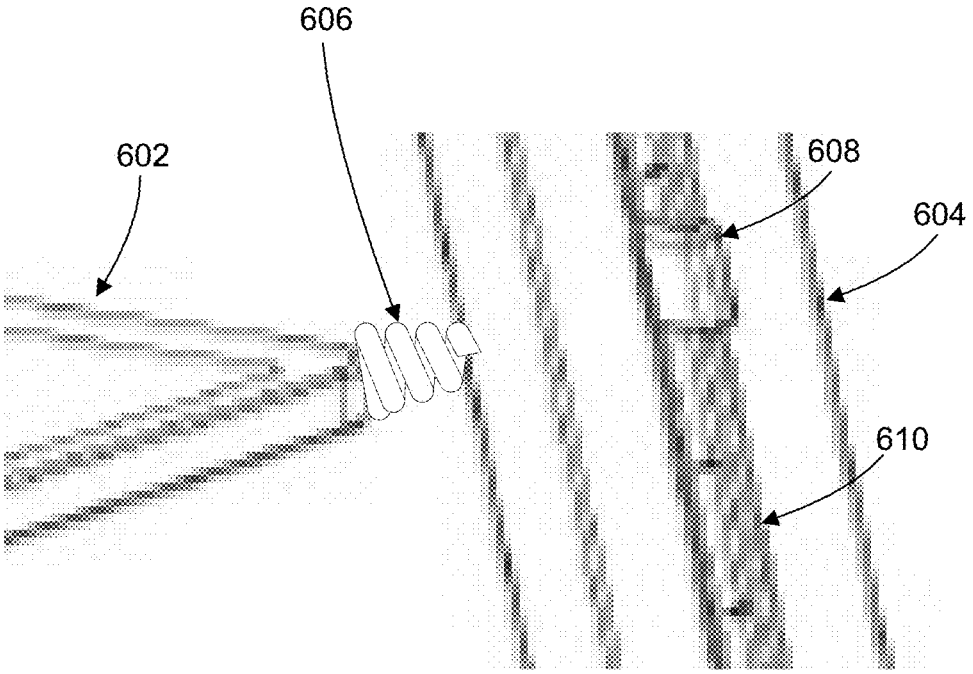
FIG. 6 illustrates an example attachment mechanism for a platform.

FIG. 6 illustrates an example attachment mechanism 606 for a platform 602. The attachment mechanism 606 may include one or more of the features of the attachment mechanisms described throughout this disclosure. Further, the platform 602 may include one or more of the features of the platforms or the platform assemblies described throughout this disclosure. The attachment mechanism 606 may be attached at a corner of the platform 602 and may attach the platform 602 to a base structure 604. While the attachment mechanism 606 is illustrated as being attached to a corner of the platform 602, it is to be understood that the attachment mechanism 606 may be attached to any portion of the platform 602.

The attachment mechanism 606 may comprise a spring extending between the platform 602 and the base structure 604. The attachment mechanism 606 may be configured to extend in response to force being applied to the platform 602 and contract in response to the force being reduced or removed from the platform 602, thereby returning the platform 602 to a resting position.

The attachment mechanism 606 may attach to an adjustment mechanism 608 of the base structure 604. The adjustment mechanism 608 may include one or more of the features of the adjustment mechanisms described throughout this disclosure. The adjustment mechanism 608 may be configured to be fixed when the adjustment mechanism 608 is in a locked state and may slide within an adjustment slot 610 when the adjustment mechanism 608 is an unlocked state. The adjustment slot 601 may include one or more of the features of the adjustment slots described throughout this disclosure.

Figure 7:
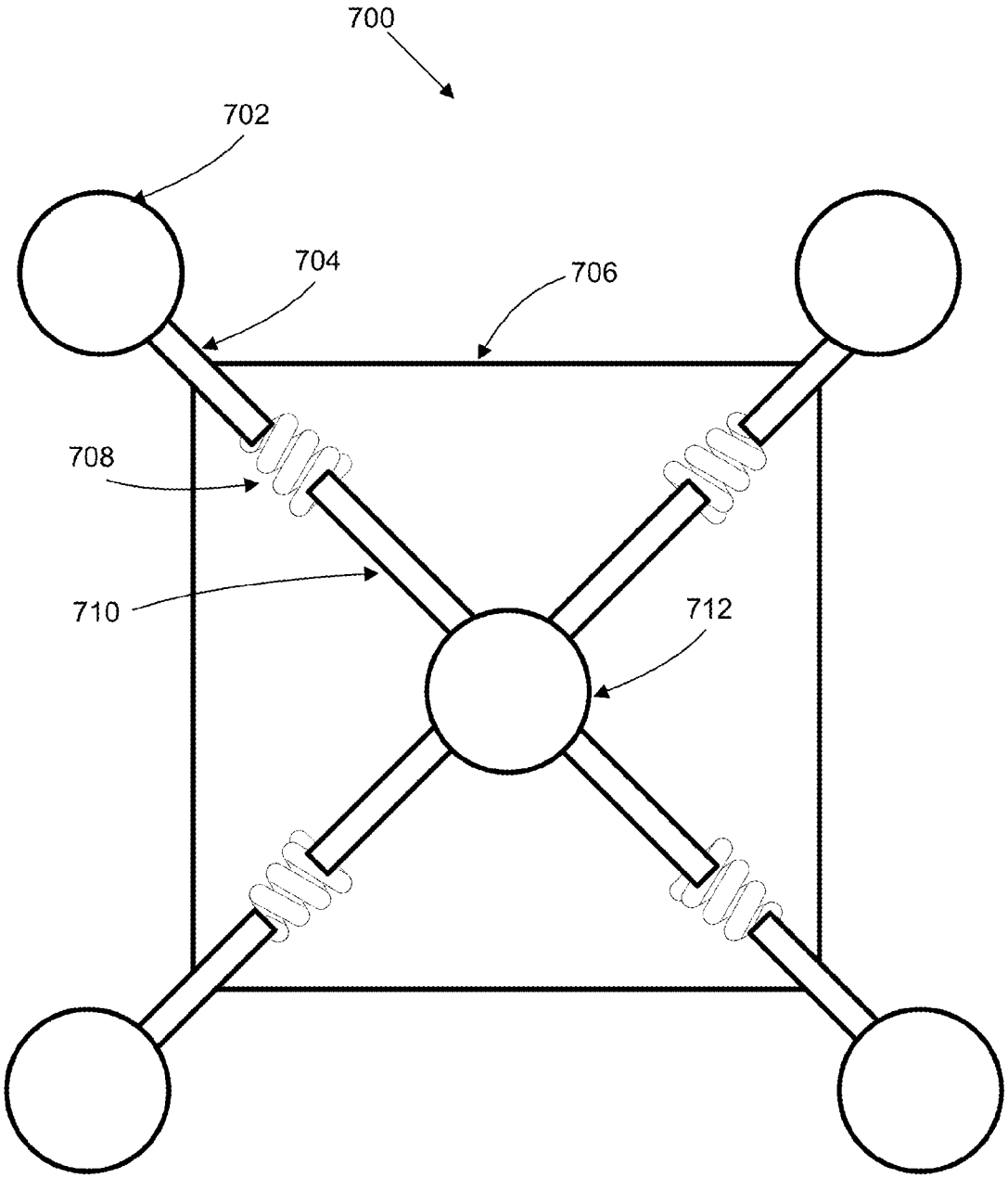
FIG. 7 illustrates a cross-sectional view of an example platform assembly.

FIG. 7 illustrates a cross-sectional view of an example platform assembly 700. The platform assembly 700 may include a platform body 706 attached to a base structure 702 by attachment mechanisms 704. The base structure 702 may include one or more of the features described of the base structures described throughout this disclosure. Further, the attachment mechanisms 704 may include one or more of the features described for any of the attachment mechanisms described throughout this disclosure.

The platform body 706 may include one or more of the features of the platforms or platform bodies described throughout this disclosure. The platform body 706 may include a three dimensional structure with a hollow inside for housing at least a portion of the platform assembly 700, such as the attachment mechanism 704, an elastic connector 708, an extension 710, a hub 712, or any combination thereof. The platform body 706 may be designed such that a user may not readily access the portion of the platform assembly 700 housed with the platform body 706.

In some examples, the platform body 706 may not fully enclose the portion of the platform assembly 700. The platform body 706 may be a solid structure with extrusions partially enclosing the portion of the platform assembly 700. Further, the platform body 706 may be designed to set on top of one or more of the attachment mechanism 704, the elastic connector 708, the extension 710, or the hub 712, and may include one or more extrusions configured to maintain the positioning of the platform body 706.

The attachment mechanism 704 may be configured to extend at least partially into the platform body 706. A first end of the attachment mechanism 704 may attach to a base structure 702, while the second end extending into the platform body 706 may attach to the elastic connector 708.

The elastic connector 708 may be comprise an elastic material or mechanism, such as bungee cords, springs, rubber bands, elastic tubing, any other type of elastic material, or any combination thereof. The elastic connector 708 may be configured to extend as a force is applied to the platform body 706, allowing the platform body 706 to be displaced from a resting position. As the force is decreased or removed from the platform body 706, the elastic connector 708 may contract, returning the platform body 706 to the resting position.

The platform assembly 700 may further include the extension 710 connecting the elastic connector 708 to the hub 712. The extension 710 may comprise an elastic material configured to stretch and retract as the force is applied to and removed from the platform body 706 or may be a rigid material that remains substantially the same length as the force is applied to the platform body 706.

The hub 712 may be a solid piece of material to which one or more of the extensions 710 may attach. The hub 712 may be located under a center position of the platform body 706. In some examples, the hub 712 may be located at different positions under the platform body 706.

In some examples, the hub 712 may be attached to the platform body 706, such that as the platform body 706 is displaced from the resting position the hub 712 remains in the same position relative to the platform body 706. Further, in some examples the hub 712 may comprise any other means of attaching one or more of the extensions 710, such as a knot attaching the one or more extensions 710 together, a hollow housing to which ends of the extensions 710 are confined, or any combination thereof.

In some examples, the elastic connector 708 may be attached directly to the hub 712. In these examples, the platform assembly 700 may comprise one or more of the attachment mechanism 704, the platform body 706, the elastic connector 708, the hub 712, or any combination thereof. In some examples the elastic connector 708 may be located closer to the hub 712 with a shorter extension 710 connecting the elastic connector 708 to the hub 712.

Figure 8:
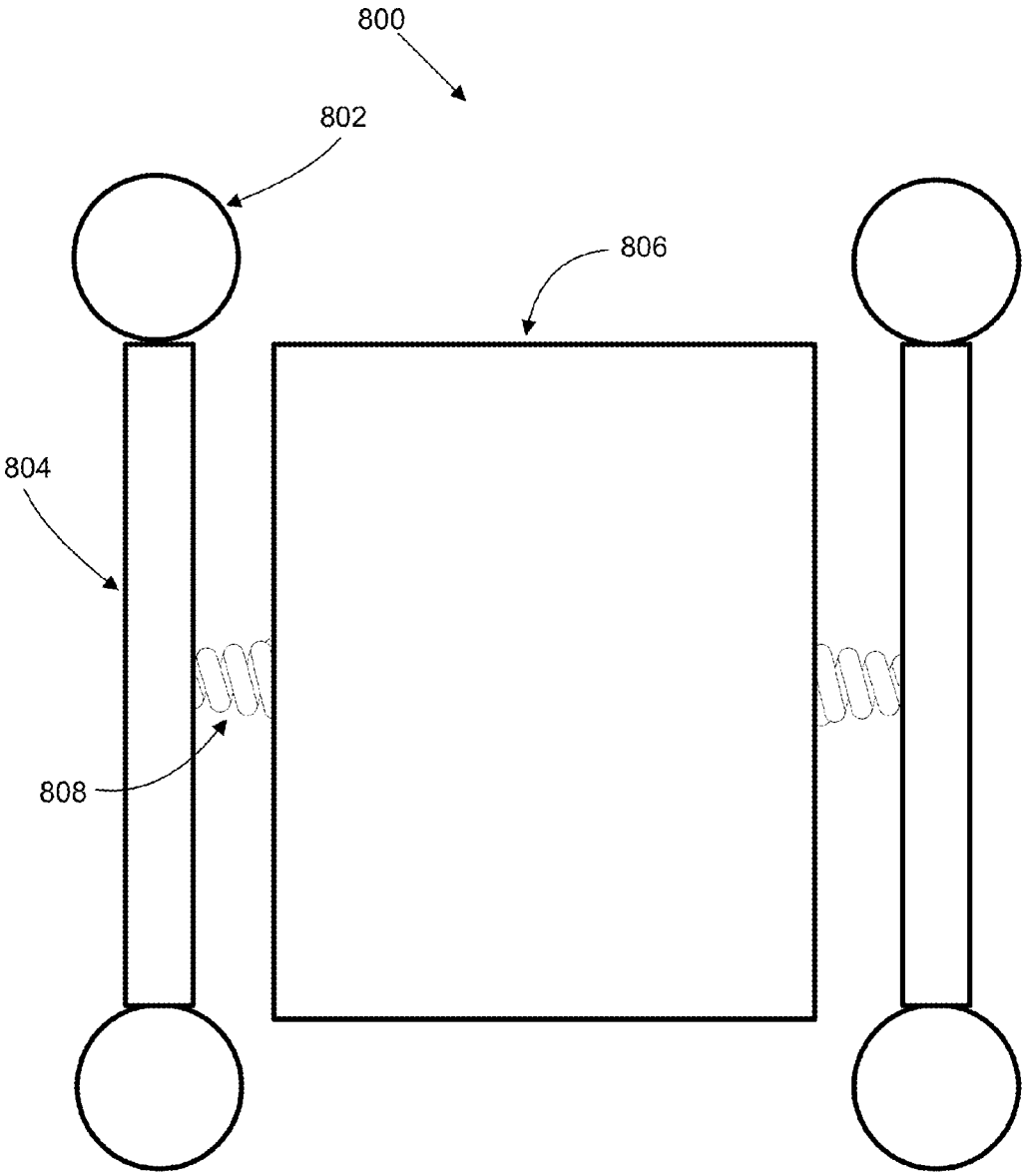
FIG. 8 illustrates a top view of another example platform assembly.

FIG. 8 illustrates a top view of another example platform assembly 800. The platform assembly 800 may include one or more attachment mechanisms 804 that extend among two or more locations on a base structure 802. The attachment mechanisms 804 may comprise a rigid material, such as wood, hard plastic, metal, any other type of rigid material, or any combination thereof, and may remain rigid as force is applied to a platform body 806. In other examples, the attachment mechanisms 804 may comprise an elastic material or mechanism, such as bungee cords, springs, rubber bands, elastic tubing, any other type of elastic material, or any combination thereof, which may be configured to extend as force is applied to the platform body 806.

One or more connectors 808 may connect the attachment mechanisms 804 to the platform body 806. The connectors 808 may comprise an elastic material or mechanism, such as bungee cords, springs, rubber bands, elastic tubing, any other type of elastic material, or any combination thereof. The connectors 808 may be configured to extend in response to force being applied to the platform body 806, allowing the platform body 806 to displace from a resting position, and contract in response to reduction or removal of the force from the platform body 806, returning the platform body 806 to the resting position.

In some examples, the connectors 808 may be configured to limit or prevent rotation of the platform body 806 when force is applied to the platform body 806. The connectors 808 may comprise a rigid material or material resisting torsion, such as a torsion spring. In some examples, the attachment mechanisms 804 may be configured to expand as force is applied to the platform body 806, allowing the platform body 806 to be displaced from a resting position, while the connectors 808 are configured to maintain the platform body 806 in a substantially horizontal orientation.

The amount of connectors 808 included in the platform assembly 800 may be less than the amount of connection points between the base structure 802 and the attachment mechanisms 804. For example, the attachment mechanisms 804 may attach to four legs of the base structure 802, while two of the connectors 808 attach the attachment mechanisms to the platform body 806. In some examples, the connectors 808 may be relatively expensive, promoting the use of fewer elastic connectors 808.

The platform body 806 may include one or more of the features of the platforms or the platform bodies described throughout this disclosure. The connectors 808 may attach to the platform body 806 at central position located between a front and a back of a high chair. However, it is to be understood that the connectors 808 may attach to the platform body 806 anywhere along the platform body 806, may extend into the platform body 806, or any combination thereof.

Figure 9:
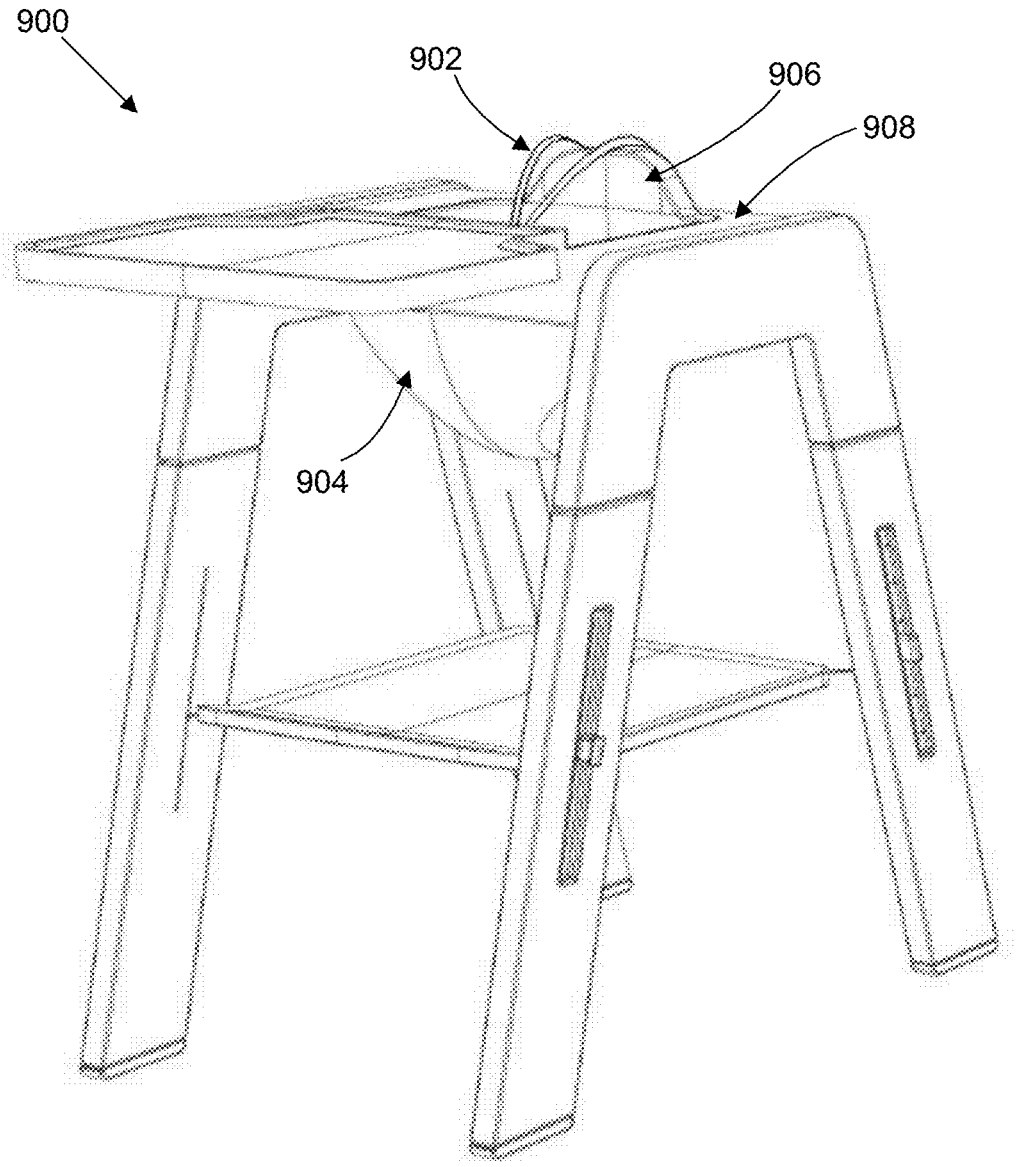
FIG. 9 illustrates a perspective view of an example high chair for a child including a restraint system.

FIG. 9 illustrates a perspective view of an example high chair 900 including a restraint system 902. The high chair 900 may include one or more of the features of the high chairs described throughout this disclosure. The restraint system 902 may be configured to restrain the child within a seat 904 of the high chair 900.

The restraint system 902 may comprise any means for restraining a baby within a seat, including, but not limited to, straps, a seat belt, an over a single shoulder harness, an over both shoulders harness, an around the waist harness, or any combination thereof. The restraint system 902 may extend from a seat back 906 of the high chair 900 to the front of the seat 904. The restraint system 902 may be configured to detach from the seat 904, the seat back 906, or both, allowing for the child to be easily removed from the high chair 900. While the restraint system 902 is described as being attached to the seat back 906 and the seat 904, it should be understood that the restraint system 902 may be connected to one or more of the other elements of the high chair 900. For example, the restraint system 902 may be attached to a support surface 908 encircling the seat 904.

The restraint system 902 may comprise straps or other restraints may of a pliable material, such as cloth, leather, rope, rubber, flexible plastic, any other pliable material, or any combination thereof. The restraint system 902 may further comprise padding placed on the straps or other restraints to provide comfort for the child restrained to the seat 904.

In some examples, the restraint system 902 may comprise a rigid material, such as wood, hard plastic, metal, any other type of rigid material, or any combination thereof, for restraining the child. The rigid restraint system 902 may be configured to be removed from the high chair 900 or may include a hinged connection to the high chair 900, allowing removal of the child from the high chair 900.

Figure 10:
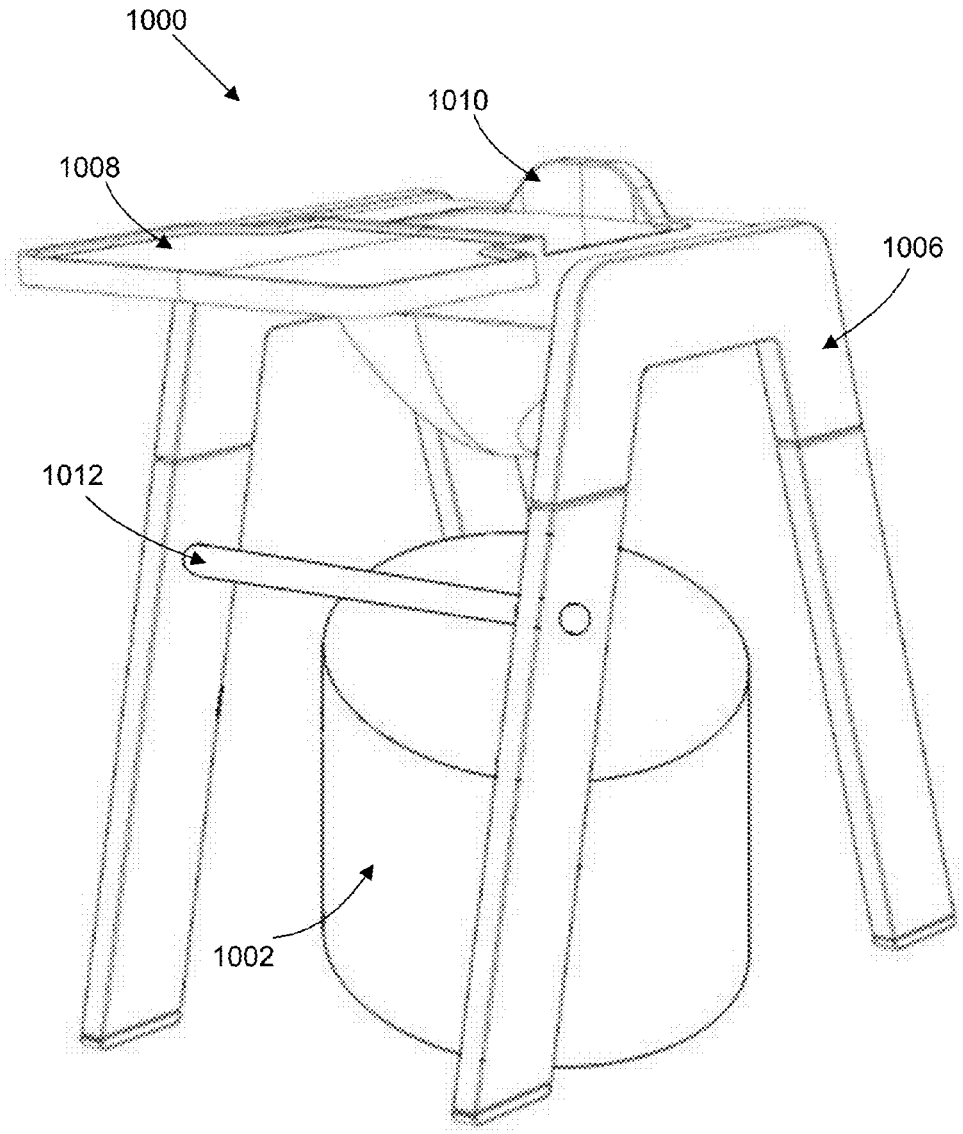
FIG. 10 illustrates a perspective view of an example high chair including a stepping stool.

FIG. 10 illustrates a perspective view of an example high chair 1000 including a stepping stool 1002. The high chair 1000 may include one or more of the features of the high chairs described throughout this disclosure.

The stepping stool 1002 may be located directly below seat 1004 or slightly in front of the seat 1004. The stepping stool 1002 may set on the same supporting surface as a base structure 1006 or on a separate, elevated surface. Stepping stool 1002 may be affixed to the base structure 1006, the seat 1004, a feeding surface 1008, a seat back 1010, a foot rest 1012, or any combination thereof. In some embodiments, the stepping stool 1002 may be configured such that a user may adjust the maximum height of the stepping stool 1002 to accommodate different sizes of children.

The stepping stool 1002 may be configured to compress in a vertical direction in response to an increase in downward force exerted upon a top surface of the stepping stool 1002 by a child. Additionally, the stepping stool 1002 may be configured to expand in the vertical direction in response to a decrease in the downward force exerted upon the top surface of the stepping stool 1002. Stepping stool 1002 may be configured to absorb the downward force exerted by the child thereby preventing, or allowing a minimal amount of, upward motion of the child's body in seat 1004 in response to the downward force exerted by the child.

The stepping stool 1002 may comprise a spring-loaded stepping stool. The springs within the stepping stool 1002 may be configured to compress in response to force being applied to the top surface of the stepping stool 1002 and expand in response to reduction or removal of the force from the top surface of the stepping stool 1002.

In some examples, the stepping stool 1002 may comprise a condensable material within a pliable container, thereby allowing the stepping stool 1002 to compress. The condensable material may include, but is not limited to, cotton, air, water, springs, pistons, shock absorbers, or any combination thereof. The pliable container may be made of cloth, rubber, plastic, or any combination thereof.

In some examples, stepping stool 1002 may comprise a mechanism allowing the condensable material to exit the pliable container in response to an increased downward force on the top surface of the stepping stool 1002 and to enter the pliable container in response to a decreased downward force on the top surface of the stepping stool 1002. The mechanism allowing the condensable material to exit or enter the pliable container may comprise one-way valves, two-way valves, or any combination thereof.

The high chair 1000 may include the foot rest 1012 extending among one or more connection points with the base structure 1006 and may be configured to allow the child to rest his feet when seated in seat 1004. The child may place his feet on the foot rest 1012 while in the seat 1004, thereby allowing the child to reduce pressure on the child's crotch exerted by the seat 1004 supporting the child's weight. The footrest 1012 may comprise a bar affixed at a first end to a first leg of the base structure 1006 and at a second end affixed to a second leg of the base structure 1006.

In some examples, the footrest 1012 may comprise a cylindrical member extending between the first leg and the second leg. The footrest 1012 may extend between a first leg and a second leg residing forward of the seat 1004, wherein the first leg is located to a first side of the seat 1004 and the second leg is located to a second side of the seat 1004 opposite the first side.

The footrest 1012 may extend horizontally among a plurality of legs comprising the base structure 1006 providing vertical support to the child's feet. In some examples, the footrest 1012 may be adjustable, such that a user may change the elevated level of the footrest 1012 to adjust for a growing child.

Figure 11:
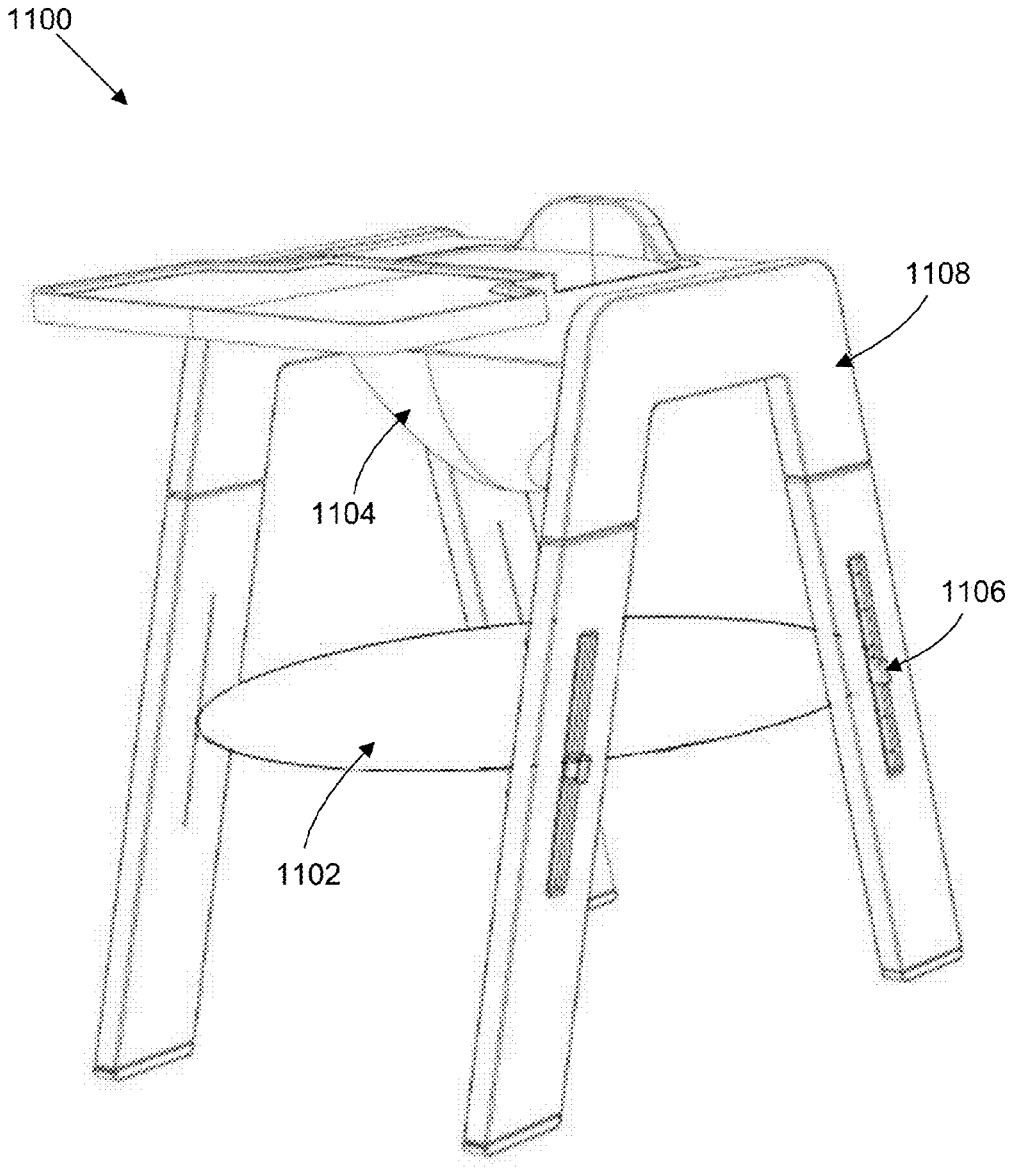
FIG. 11 illustrates a perspective view of an example high chair including a stepping cushion.

FIG. 11 illustrates a perspective view of an example high chair 1100 including a stepping cushion 1102. The high chair 1100 may include one or more of the features of the high chairs described throughout this disclosure.

The stepping cushion 1102 may extend among the base structure 1108 and may be configured to be displaced from a resting position in response to force exerted on the stepping cushion 1102 by the child. The stepping cushion 1102 may be configured such that at least an upper surface of the stepping cushion 1102 will displace in response to the force exerted by the child preventing, or allowing a minimal amount of, upward motion of the child's body in seat 1104 in response to the force exerted by the child.

In some examples, the stepping cushion 1102 may be attached to the base structure 1108 by one or more adjustment mechanisms 1106. The adjustment mechanisms 1106 may include one or more of the features of the adjustment mechanisms described throughout this disclosure. A position of the stepping cushion 1102 may be adjusted by utilizing the adjustment mechanisms 1106 to accommodate children with different leg lengths.

The stepping cushion 1102 may comprise an oval shape, wherein the stepping cushion 1102 may be affixed to four legs of a base structure 1108. The stepping cushion 1102 may comprise a pliable container, wherein the pliable container may be filled with a gas, a liquid, a compressible material, or any combination thereof. In some examples, the stepping cushion 1102 may comprise an air-filled bladder configured to deform in response to force being applied to the stepping cushion 1102 by the child and return to the bladder's original shape in response to force being removed.

In some examples, stepping cushion 1102 may comprise a mechanism allowing the contents of the stepping cushion 1102 to exit the pliable container in response to an increased force on the stepping cushion 1102 and to enter the pliable container in response to a decreased force on the stepping cushion 1102. The mechanism allowing contents to exit or enter the pliable container may comprise one-way valves, two-way valves, or any combination thereof.

Figure 12:
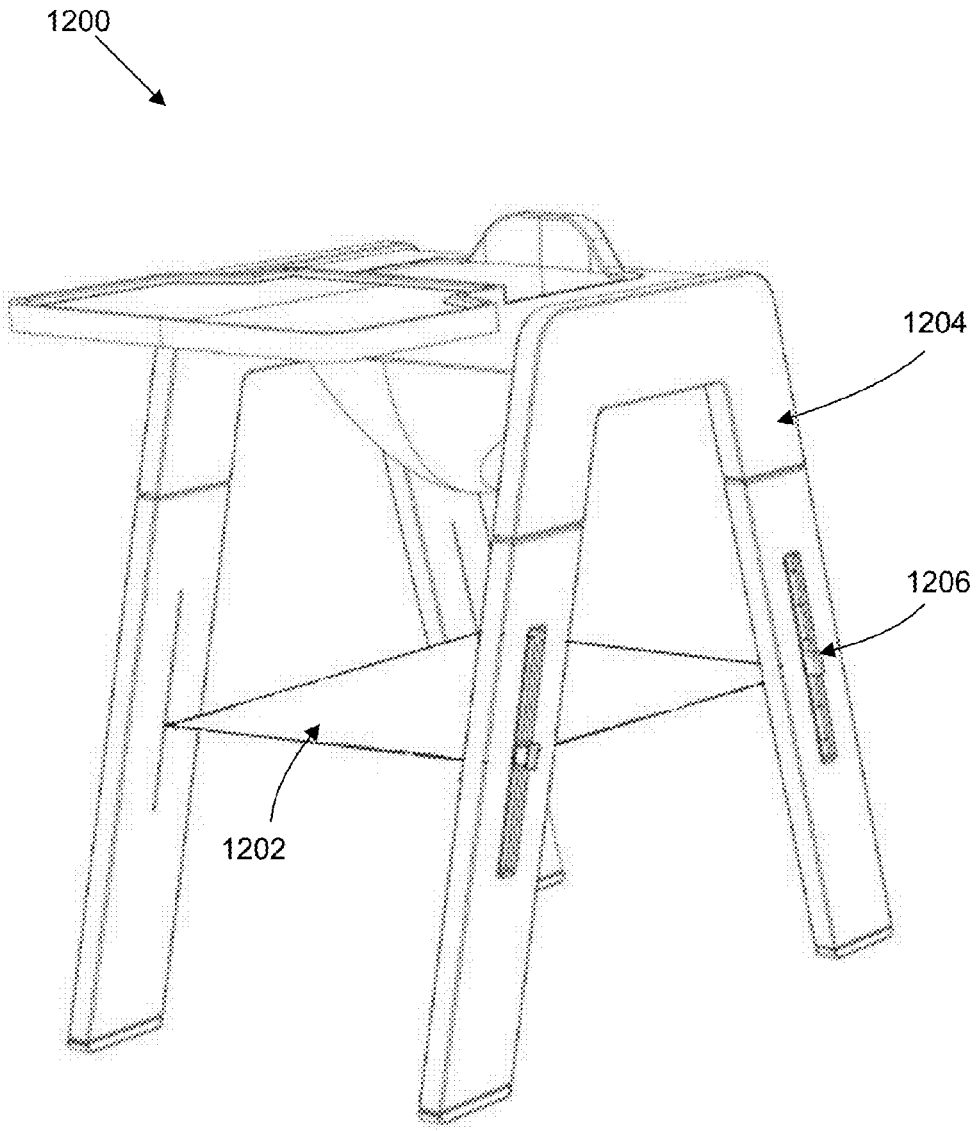
FIG. 12 illustrates a perspective view of an example high chair including a platform rigidly attached to a base structure.

FIG. 12 illustrates a perspective view of an example high chair 1200 including a platform 1202 rigidly attached to a base structure 1204. The high chair 1200 may include one or more of the features of the high chairs described throughout this disclosure. Further, the base structure 1204 may include one or more of the features of the base structures described throughout this disclosure.

The platform 1202 may be rigidly attached to the base structure 1204, in contrast to previously described examples including an attachment mechanism. The platform 1202 may comprise an elastic material such as canvas, woven polypropylene, any other type of elastic material, or any combination thereof. The elastic material of the platform 1202 may be configured to expand, bend, flex, stretch, or any combination thereof, in response to force being applied to the platform 1202 by the child. The platform 1202 may be configured to return to the original shape in response to the force being removed from the platform 1202.

The platform 1202 may be attached to the base structure 1204 by one or more adjustment mechanisms 1206. The adjustment mechanisms 1206 may include one or more of the features of the adjustment mechanisms described throughout this disclosure. The resting position of the platform 1202 may be adjusted by utilizing the adjustment mechanisms 1206, thereby accommodating different sizes of children.

Figure 13:
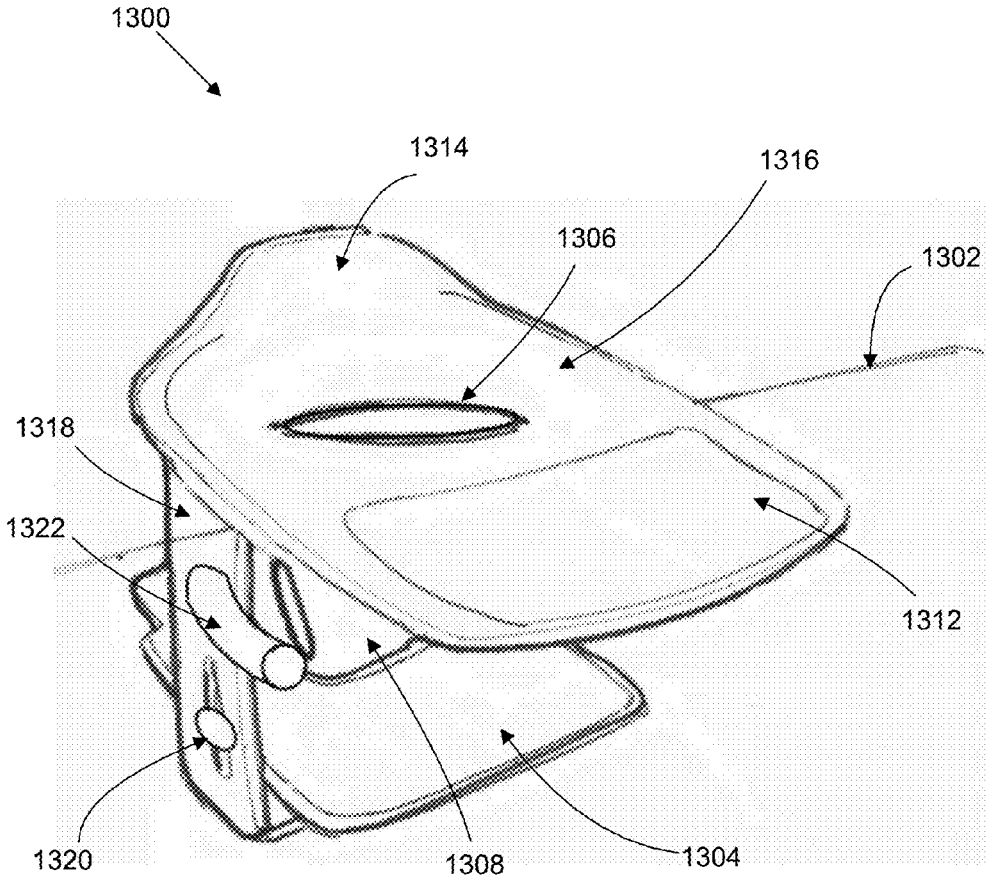
FIG. 13 illustrates a perspective view of an example table-mounted high chair for a child.

FIG. 13 illustrates a perspective view of an example table-mounted high chair 1300 for a child. The table-mounted high 1300 may include one or more of the features of the high chairs described throughout this disclosure.

The high chair 1300 may include a support structure 1316 with a feeding surface 1312. The feeding surface 1312 may include one or more of the features of the feeding surfaces described throughout this disclosure. The portion of the support structure 1316, including the feeding surface 1312, may be configured to set on the table top of the table 1302 and support the high chair 1300 on the table 1302.

The high chair 1300 may further comprise a mounting mechanism 1322 for securing the high chair 1300 to the table 1302. The mounting mechanism 1322 may be configured to press against a bottom of the table top, thereby applying a clamping force to the table 1302 generated by the structure surface 1312 setting on top of the table 1302 and the mounting mechanism 1322. The mounting mechanism 1322 may be quickly disengaged from the table 1302 allowing easy removal of the high chair 1300 from the table 1302.

The mounting mechanism 1322 may be attached to one or more platform-mounting extensions 1318. The extensions 1318 may be attached to the support surface 1316 and may extend downward from the support surface 1316. The support surface 1316 may be configured to support the extensions 1318 above a surface on which the table 1302 sets.

While the mounting mechanism 1322 is described as being attached to the extensions 1318, it is to be understood that the mounting mechanism 1312 may be attached to any other portion of the high chair 1300. For example, the mounting mechanism 1312 may be attached to a portion the support structure 1316 not setting on the table and may extend below the table top underneath the portion of the support structure 1316 setting on the table.

Further, while the high chair 1300 is described as being mounted to the table 1302 by the support structure 1316 and the mounting mechanism 1312, it is to be understood that the high chair may be mounted to the table by other means. For example, other elements of the high chair 1300 may set on top of the table 1302 supporting the high chair 1300, mounting brackets may attach the high chair 1300 to the table, the high chair may be attached to the table by hardware including screws and/or nails, the high chair may include a clamping mechanism for attaching to the table 1302, other means of attachment, or any combination thereof.

The high chair 1300 may include a seat 1308 attached to the support structure 1316, the support structure 1316 having a cutout 1306 for attachment of the seat 1308. The support structure 1316 may be configured to support the seat 1308 adjacent to the table 1302. The seat 1308 may include one or more of the features of the seats described throughout this disclosure. The support structure 1316 may further comprise a seat back 1314 extending upward from the back of the cutout 1306. The seat back 1314 may include one or more of the features of the seat backs described throughout this disclosure.

The high chair 1300 may further include a platform 1304 located at least partially below the seat 1308. The platform 1304 may include one or more of the features of the platforms or platform assemblies described throughout this disclosure. Further, the platform 1304 may be attached to the extensions 1318 by one or more of the means of attachment described throughout this disclosure, including the attachment mechanisms 114 (FIG. 1), the attachment mechanisms 704 (FIG. 7), the attachment mechanisms 804 (FIG. 8), the rigid attachment described in FIG. 12, or any combination thereof.

The high chair 1300 may further include adjustment mechanisms 1320 for adjusting a resting position of the platform 1304. The adjustment mechanisms 1320 may include one or more of the features of the adjustment mechanisms described throughout this disclosure. The adjustment mechanisms 1320 may movably attach the platform 1304 to the extensions 1318. When the adjustment mechanisms 1320 are in a locked state, the resting position of the platform 1304 relative to the extensions 1318 may be fixed. When the adjustment mechanisms 1320 are in an unlocked state, the resting position of the platform 1304 may adjusted along the extensions 1318. The adjustment may change the distance between the seat 1308 and the platform 1304, thereby accommodating children with different leg lengths.

Figure 14:
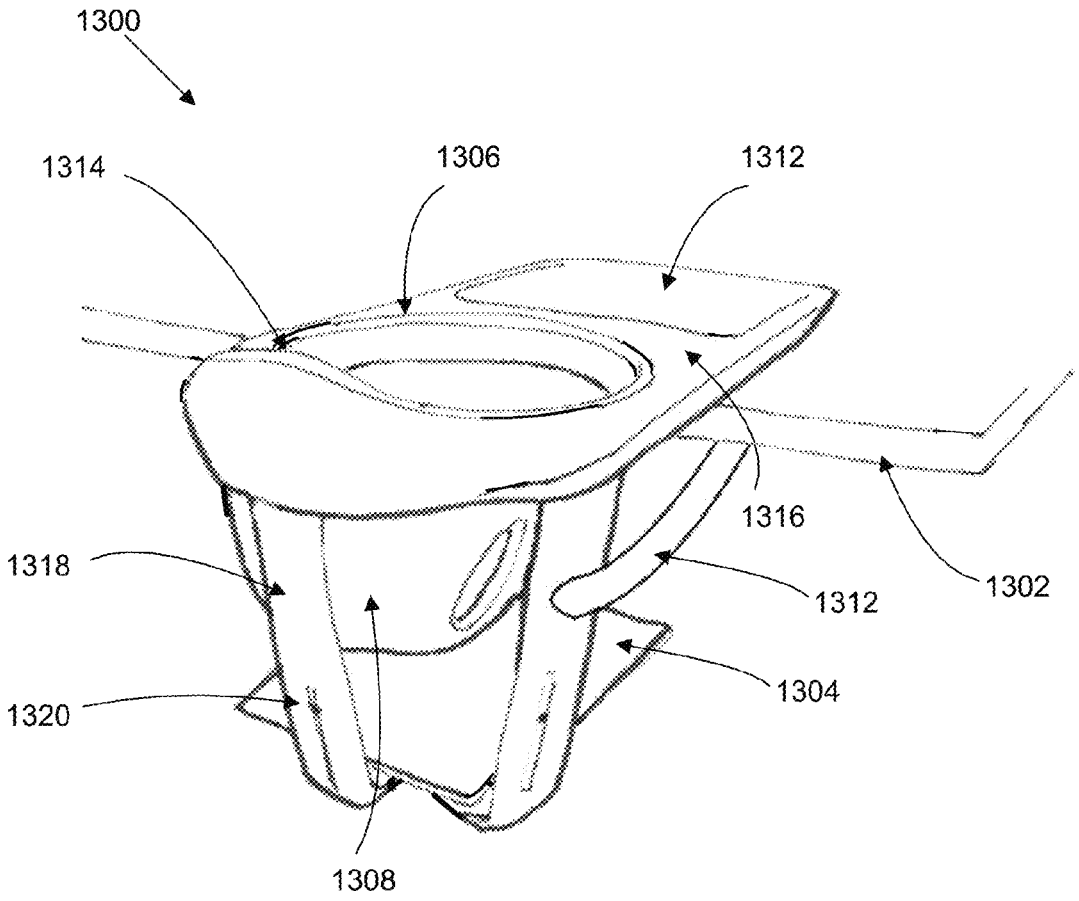
FIG. 14 illustrates a different perspective view of the example table-mounted high chair of FIG. 13.

FIG. 14 illustrates a different perspective view of the example table-mounted high chair 1300 of FIG. 13. As can be seen, the high chair 1300 may include one or more of the platform-mounting extensions 1318 extending downward from the support structure 1316. The extensions 1318 may extend downward from the sides of the support structure 1316 and the back of the support structure 1316. The extensions 1318 may further curve at one end with a portion of the extensions 1318 extending below the platform 1304.

While the extensions 1318 have been described as extending downwards from the back of the support structure 1316 and the sides of the support structure 1316, it is to be understood that the extensions 1318 may be attached to any portion of the support structure 1316 and may extend downward from any portion of the support structure 1316. Further, it is to be understood that the extensions 1318 may be attached to any other element, or a combination thereof, of the high chair 1300.

Figure 15:
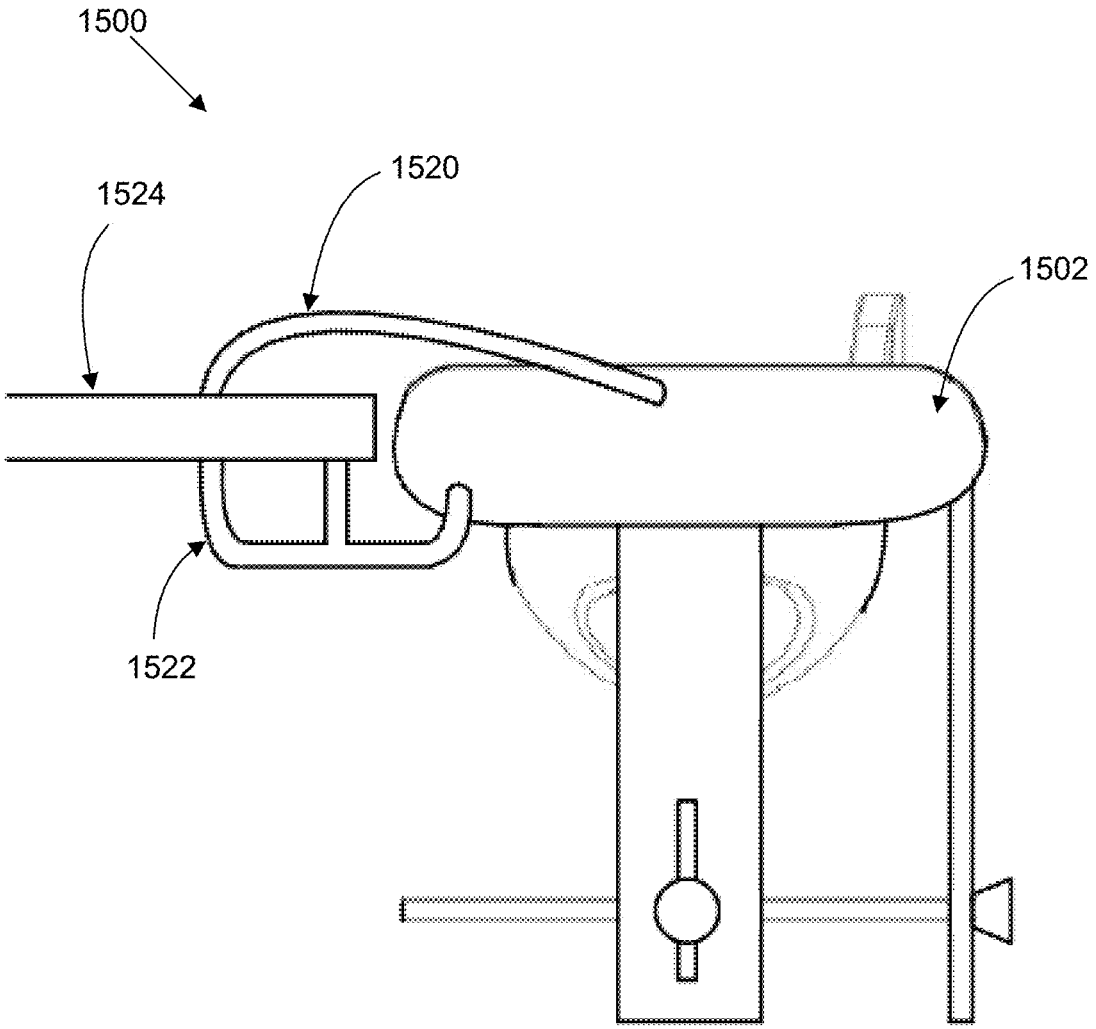
FIG. 15 illustrates a side view of another table-mounted high chair.

FIG. 15 illustrates a side view of another table-mounted high chair 1500. The high chair 1500 may include one or more of the features of the high-chairs or the table-mounted high chairs described throughout this disclosure.

The high chair 1500 may include an upper mounting mechanism 1520 and a lower mounting mechanism 1522. The upper mounting mechanism 1520 may be attached to a support structure 1502 of the high chair 1500. The upper mounting mechanism 1520 may be rotationally attached to the support structure 1502.

The upper mounting mechanism 1520 may be configured to contact a top surface of a table top 1524 and support the high chair 1500 on the table top 1524. The upper mounting mechanism 1520 may be rotated to a desired position for contacting the table top 1524 and then locked into place to support the high chair 1500. While the upper mounting mechanism 1520 is illustrated as having a single contact point with the table top 1524, it is to be understood that the upper mounting mechanism 1520 may include multiple contact points with the table top 1524.

The lower mounting mechanism 1522 may also be rotationally attached to the support structure 1502. The lower mounting mechanism 1522 may be configured to contact bottom surface of the table top 1524 and provide a clamping function of the table top 1524 in combination with the upper mounting mechanism 1522. The lower mounting mechanism 1522 may be rotated to a position applying an upward force on the bottom surface of the table top 1524 and locked into place to maintain the clamping function. While the lower mounting mechanism 1522 is illustrated as having two contact points with the table top 1524, it is to be understood that the lower mounting mechanism 1522 may include one or more contact points with the table top 1524.

In some examples, one of the upper mounting mechanism 1520 and the lower mounting mechanism 1522 may be rigidly attached to the support structure 1502, while the other of the upper mounting mechanism 1520 and the lower mounting mechanism 1522 is adjustable to perform the clamping function. Further, while the upper mounting mechanism 1520 and the lower mounting mechanism 1522 are illustrated as being attached to the support structure 1502, it is to be understood that one or both of the upper mounting mechanism 1522 and the lower mounting mechanism 1522 may be attached to different elements of the high chair 1500.

Several examples have been described above with reference to the accompanying drawings and pictures. Various other examples of the invention are also possible and practical. The system may be exemplified in many different forms and should not be construed as being limited to the examples set forth above.

The figures listed above illustrate examples of the subject matter and the operation of such examples. In the figures, the size of the elements are not intended to represent the size of the various physical components. Where the same element appears in multiple figures, the same reference numeral is used to denote the element in all of the figures where it appears.

Only those parts of the various units are shown and described which are necessary to convey an understanding of the examples to those skilled in the art. Those parts and elements not shown may be conventional and known in the art.

Having described and illustrated the principles of the invention in a preferred embodiment thereof, it should be apparent that the invention may be modified in arrangement and detail without departing from such principles. I claim all modifications and variation coming within the spirit and scope of the following claims.

What is claimed is:

1. A high chair for holding a child while the child is handling food or drink, comprising:

a seat configured to support an entire weight of the child and suspend a body of the child in a standing or walking upright body position, the seat being made of a pliable material and having two symmetrically opposed apertures for accommodating legs of the child, wherein the two symmetrically opposed apertures are to suspend the two legs of the child in a downwardly extended standing or walking position directly below the seat while the child is handling the food or drink to accommodate a stepping reflex of the child;

a stationary base structure attached to the seat and extending downward from the seat;

a laterally and longitudinally elongated platform attached to the stationary base structure and located below the seat, wherein the platform is configured to deflect from a resting position in response to a force applied to the platform by the child, via feet of the child being pushed down and applying the force to the platform, while the child is handling the food or drink, so both of the legs of the child can extend further downward and the feet of the child can step, push, or kick downward against the platform giving the child a sense of walking or standing, to satisfy the stepping reflex of the child, while at the same time preventing upward motion of the upper body of the child, while the seat continues to substantially support the entire weight of the child and suspend the body of the child, and maintains a secured and confined suspended upper body position of the child so the child is prevented from using the platform to push up and out of the seat, or bounce up and down in the seat reducing chances of spillage or droppage of the food or drink while eating;

first, second, third, and fourth attachment mechanisms that attach the platform to the stationary base structure, wherein the first, second, third, and fourth attachment mechanisms attach directly to first second third and fourth legs respectively, of the stationary base structure wherein the first, second, third, and fourth attachment mechanisms are configured to expand in response to the force applied to the platform by the child to enable the platform to be deflected from the resting position, and wherein the seat is configured to continue to substantially support the entire weight of the child and suspend the body of the child due to a lack of upward force supplied by the platform as the first, second, third, and fourth attachment mechanisms expand during deflection due to the force applied to the platform while the child is handling the food or drink; and a feeding surface attached to the stationary base structure, the feeding surface to allow for placement of the food or drink on the feeding surface, wherein the child can consume the food or drink while suspended in the standing or walking position without spilling or dropping the food from any stepping reflex that positions the legs in an extended position.

2. The high chair of claim 1, wherein the platform is located at a distance below the seat at an edge of a reach of the legs of the child.

3. The high chair of claim 1, wherein the platform comprises a rigid material and the first second third and fourth platform attachment mechanisms comprise a resilient material that allows the platform to deflect from the resting position in response to the force applied to the platform.

4. The high chair of claim 1, wherein the first second third and fourth attachment mechanisms include first, second, third, and fourth tension springs, respectively, and wherein the first, second, third, and fourth tension springs are configured to extend as the platform deflects from the resting position and contract as the force is removed from the platform.

5. The high chair of claim 1, wherein the first second third and fourth attachment mechanisms include first, second, third, and fourth bungee cords, respectively, and wherein the first, second, third, and fourth bungee cords are configured to absorb the force applied to the platform by the child.

6. The high chair of claim 1, wherein the platform comprises flexible material, and wherein the platform is configured to flex as the force is applied.

7. The high chair of claim 1, further comprising a platform adjustment mechanism attaching the platform to the stationary base structure, wherein the platform adjustment mechanism provides vertical adjustment of the resting position of the platform.

8. The high chair of claim 1, wherein the stationary base structure comprises a height adjustment mechanism, and wherein the height adjustment mechanism is configured to adjust a height of the platform with respect to the seat.

9. An apparatus for supporting a child while the child is handling food or drink, the apparatus comprising:

a seat configured to support the child and to suspend a body of the child in a standing or walking upright body position, the seat being made of a pliable material and having two apertures allowing feet of the child to extend beneath the seat while the child is handling the food or drink;

a stationary base structure attached to the seat and configured to support the seat on a surface;

a platform attached to the stationary base structure, the platform being located at least partially directly beneath the seat and to be contacted by the feet of the child, wherein the platform is configured to displace from an initial position in response to a force applied to the platform by the feet of the child so legs of the child can extend further downward and the feet of the child can step, push, or kick downward against the platform giving the child a sense of walking or standing while at the same time preventing upward motion of the upper body of the child while the child remains supported by the seat to reduce chances of spillage or droppage of the food or drink, and wherein the platform is configured to return to the initial position in response to removal of the force so the child maintains a secured and confined suspended upper body position in the seat and is prevented from using the platform to push up and out of the seat, or bounce up and down in the seat while eating;

first, second, third, and fourth attachment mechanisms that attach the platform to the stationary base structure, wherein the first second third and fourth attachment mechanisms attach directly to first second third and fourth legs respectively, of the stationary base structure, wherein the first second third and fourth attachment mechanisms are configured to expand as the platform is displaced from the initial position in response to the force applied to the platform by the feet of the child, and wherein a lack of upward force supplied by the platform during expansion of the first, second, third, and fourth more attachment mechanisms prevents the upward motion of the upper body of the child and reduces the chances of spillage or droppage of the food or drink; and a feeding surface attached to the stationary base structure, the feeding surface to allow for placement of the food or drink on the feeding surface, wherein the child can consume the food or drink while supported by the seat with the feet of the child extended beneath the seat.

10. The apparatus of claim 9, wherein the platform comprises a resilient material configured to bend in response to the force being applied to the platform and straighten in response to the force being removed.

11. The apparatus of claim 9, wherein the seat comprises a pliable sling, wherein the apparatus further comprises a seat back affixed to the stationary base structure, wherein the seat back extends at least partially around the seat, and wherein the sling and the seat back are configured to maintain the secured and confined suspended upper body position.

12. The apparatus of claim 9, further comprising an adjustment mechanism attaching the platform to the stationary base structure, wherein the adjustment mechanism provides adjustment of a distance between the seat and the platform.

13. The apparatus of claim 9, wherein the first, second, third, and fourth attachment mechanisms include first, second, third, and fourth springs, respectively, and wherein the first second third and fourth springs are configured to extend as the platform displaces from the initial position and contract as the platform returns to the initial position.

14. The high chair of claim 1, wherein the two symmetrically opposed apertures are located within a lower portion of the seat.

15. A high chair for a child, the high chair comprising:

a first section including a feeding surface and a seat;

a second section located below the seat and arranged to make movements away from the first section corresponding to extensions of the legs of the child while the child is seated in the seat, the second section including:

a plurality of elastic members, the plurality of elastic members including:

a first elastic member having a first end directly coupled to a first leg of legs of the high chair;

a second elastic member having a first end directly coupled to a second leg of the legs of the high chair;

a third elastic member having a first end directly coupled to a third leg of the legs of the high chair; and a fourth elastic member having a first end directly coupled to fourth leg of the legs of the high chair; and a platform formed of a rigid material to resist deformation, the platform including a surface to contact a foot or feet of the child, the platform including first, second, third, and fourth regions to couple to second ends of the first, second, third, and fourth elastic members, respectively; and wherein the second section is arranged to maintain a position of the child's upper body responsive to applications of force applied by the child to the surface of the platform, the second section arranged to maintain the position based on an elasticity of the plurality of elastic members, a range of expansion of the plurality of the elastic members associated with a distance between the surface of the platform and the seat when the plurality of elastic members are in an initial state, a rigidity of the material of the platform, and locations of the regions of the platform.

16. The high chair of claim 15, the seat being of pliable material and including two symmetrically opposed apertures to accommodate the legs of the child in a downwardly extended standing or walking position, wherein the first section further includes:

a base structure coupled to the seat, the base structure including:

a support structure that extends around an upper edge of the seat, the seat to hang downward from the support structure; and the legs, wherein the legs are attached to the seat via the support structure, and wherein the legs extend downward from the support structure and are to support the support structure and the seat.

17. The high chair of claim 15, wherein the first elastic member, the second elastic member, the third elastic member, and the fourth elastic member are to expand responsive to the applications of the force applied by the child and return to the initial state absent the applications of the force applied by the child, and wherein the seat continues to support the child while the first elastic member, the second elastic member, the third elastic member, and the fourth elastic member are expanded.

18. The high chair of claim 15, wherein each of the first leg, the second leg, the third leg, and the fourth leg of the legs includes a series of holes formed along a length of each of the first leg, the second leg, the third leg, and the fourth leg, wherein the first end of the first elastic member interchangeably couples to a hole of the series of holes formed in the first leg, wherein the first end of the second elastic member interchangeably couples to a hole of the series of holes formed in the second leg, wherein the first end of the third elastic member interchangeably couples to a hole of the series of holes formed in the third leg, wherein the first end of the fourth elastic member interchangeably couples to a hole of the series of holes formed in the fourth leg, and wherein a position of the platform is adjustable via interchangeably coupling the first end of the first elastic member, the first end of the second elastic member, the first end of the third elastic member, and the first end of the fourth elastic member to other holes of the series of holes formed in the first leg, the second leg, the third leg, and the fourth leg.

19. The high chair of claim 15, wherein the first elastic member, the second elastic member, the third elastic member, and the fourth elastic member are to produce, in response to the applications of the force applied by the child, a maximum combined force of resistance to displacement of the platform such that the seat continues to support the child.

20. The high chair of claim 15, wherein the locations of the first, second, third, and fourth regions include first, second, third, and fourth corners of the platform, respectively.

* * * * *